US010914456B2

(12) United States Patent
Paulsel et al.

(10) Patent No.: US 10,914,456 B2
(45) Date of Patent: Feb. 9, 2021

(54) MOUNTING SYSTEM FOR MAGNETIC INSTALLATION OF A RIMLESS FINISHING SECTION

(71) Applicant: SIGNIFY HOLDING B.V., Eindhoven (NL)

(72) Inventors: Jason Q. Paulsel, Peachtree City, GA (US); Kevin R. Harpenau, Atlanta, GA (US); Grzegorz Wronski, Peachtree City, GA (US); Zhihong Lin, Shanghai (CN)

(73) Assignee: SIGNIFY HOLDING B.V., Eindhoven (NL)

( * ) Notice: Subject to any disclaimer, the term of this patent is extended or adjusted under 35 U.S.C. 154(b) by 0 days.

(21) Appl. No.: 16/588,160

(22) Filed: Sep. 30, 2019

(65) Prior Publication Data

US 2020/0063946 A1 Feb. 27, 2020

Related U.S. Application Data

(63) Continuation of application No. 16/112,385, filed on Aug. 24, 2018, now Pat. No. 10,429,039.

(51) Int. Cl.
*F21V 17/10* (2006.01)
*F21V 21/04* (2006.01)

(52) U.S. Cl.
CPC ..... *F21V 17/105* (2013.01); *F21V 21/04* (2013.01)

(58) Field of Classification Search
CPC ..... F21V 17/105; F21V 21/04
See application file for complete search history.

(56) References Cited

U.S. PATENT DOCUMENTS

| | | | | |
|---|---|---|---|---|
| 10,429,039 | B1 * | 10/2019 | Paulsel | F21V 17/105 |
| 2012/0314429 | A1 ‡ | 12/2012 | Plunk | F21V 17/105 362/374 |
| 2016/0305641 | A1 ‡ | 10/2016 | Lin | F21V 15/013 |

* cited by examiner
‡ imported from a related application

*Primary Examiner* — Joseph L Williams

(57) ABSTRACT

A mounting system includes an upper collar, a first lower collar that is configured to magnetically couple a rimmed finishing section to a luminaire, and a second lower collar that is configured to magnetically couple a rimless finishing section to the recessed luminaire. The first lower collar is removably coupled to the upper collar when the rimmed finishing section is to be coupled to the recessed luminaire, and the second lower collar is removably coupled to the upper collar when the rimless finishing section is to be coupled to the recessed luminaire.

20 Claims, 23 Drawing Sheets

202
208
202
208
202
208

MOUNTING SYSTEM FOR MAGNETIC INSTALLATION OF A RIMLESS FINISHING SECTION

RELATED APPLICATIONS

The present application is a continuation application of and claims priority to U.S. Non-Provisional patent application Ser. No. 16/112,385 filed Aug. 24, 2018 (now U.S. Pat. No. 10,429,039 issued on Oct. 1, 2019) and titled "Mounting System For Magnetic Installation Of Varying Finishing Sections," the entire content of which is incorporated herein by reference.

TECHNICAL FIELD

Embodiments of the present disclosure relate generally to luminaires, and more particularly to a mounting system for magnetic installation of varying finishing sections in recessed luminaires.

BACKGROUND

Luminaires, such as ceiling-mounted, wall-mounted, or surface-mounted luminaires, commonly illuminate spaces in which people live, work, or play. One such type of luminaire is the recessed luminaire, which is installed within an aperture formed in a ceiling such that the luminaire is recessed behind the ceiling. Typically, recessed luminaires may include at least: (a) a recessed housing assembly that defines a cavity that houses a light source therein to emit light through the aperture in the ceiling into the area that is to be illuminated, such as a room, and (b) a finishing section that is coupled to the recessed housing assembly and disposed below the light source such that an integrated rim or a removably attached rim (e.g., trim ring) (herein collectively referred to as a "rim") of the finishing section may engage the ceiling to cover any undesirable space formed between the recessed luminaire and a perimeter of the aperture formed in the ceiling.

While the rim of the finishing section may be acceptable to some end users, other end users may find the rim to be aesthetically unappealing and may prefer a rimless installation, i.e., a recessed luminaire installation with a rimless finishing section. Rimmed and/or rimless finishing sections of various sizes, shapes, and colors are available to meet a customer's design needs. However, a conversion from a rimmed installation of a recessed luminaire with a rimmed finishing section to a rimless installation of the recessed luminaire with a rimless finishing section or vice-versa may be challenging, cumbersome, and cost-intensive.

Further, the thickness of the ceiling into which the recessed luminaires are installed may vary widely from one installation to another, and conventional mounting systems do not readily accommodate the mounting of the recessed luminaires in ceilings of different thicknesses or adjust to their varying tolerances. Traditional solutions include maintaining numerous recessed housing assemblies and finishing sections for the different ceiling thicknesses. Said traditional solutions may be inefficient and cost intensive.

This background information is provided to reveal information believed to be of possible relevance to the present disclosure. No admission is necessarily intended, nor should be construed, that any of the preceding information constitutes prior art against the present disclosure.

SUMMARY

In one aspect, a mounting system includes an upper collar, a first lower collar that is configured to magnetically couple a rimmed finishing section to a recessed luminaire, and a second lower collar that is configured to magnetically couple a rimless finishing section to the recessed luminaire. The first lower collar is removably coupled to the upper collar when the rimmed finishing section is to be coupled to the recessed luminaire. Further, the second lower collar is removably coupled to the upper collar when the rimless finishing section is to be coupled to the recessed luminaire.

In another aspect, a luminaire includes a mounting system that is adjustably coupled to a plaster frame and configured to couple one of a rimmed finishing section and a rimless finishing section to the luminaire. The mounting system includes an upper collar, a first lower collar that is configured to magnetically couple a rimmed finishing section to the luminaire, and a second lower collar that is configured to magnetically couple a rimless finishing section to the luminaire. The first lower collar is removably coupled to the upper collar when the rimmed finishing section is to be coupled to the luminaire. Further, the second lower collar is removably coupled to the upper collar when the rimless finishing section is to be coupled to the luminaire.

These and other aspect, objects, features, and embodiments, will be apparent from the following description and the appended claims.

BRIEF DESCRIPTION OF THE FIGURES

The foregoing and other features and aspects of the present disclosure are best understood with reference to the following description of certain example embodiments, when read in conjunction with the accompanying drawings, wherein.

Figure 1:
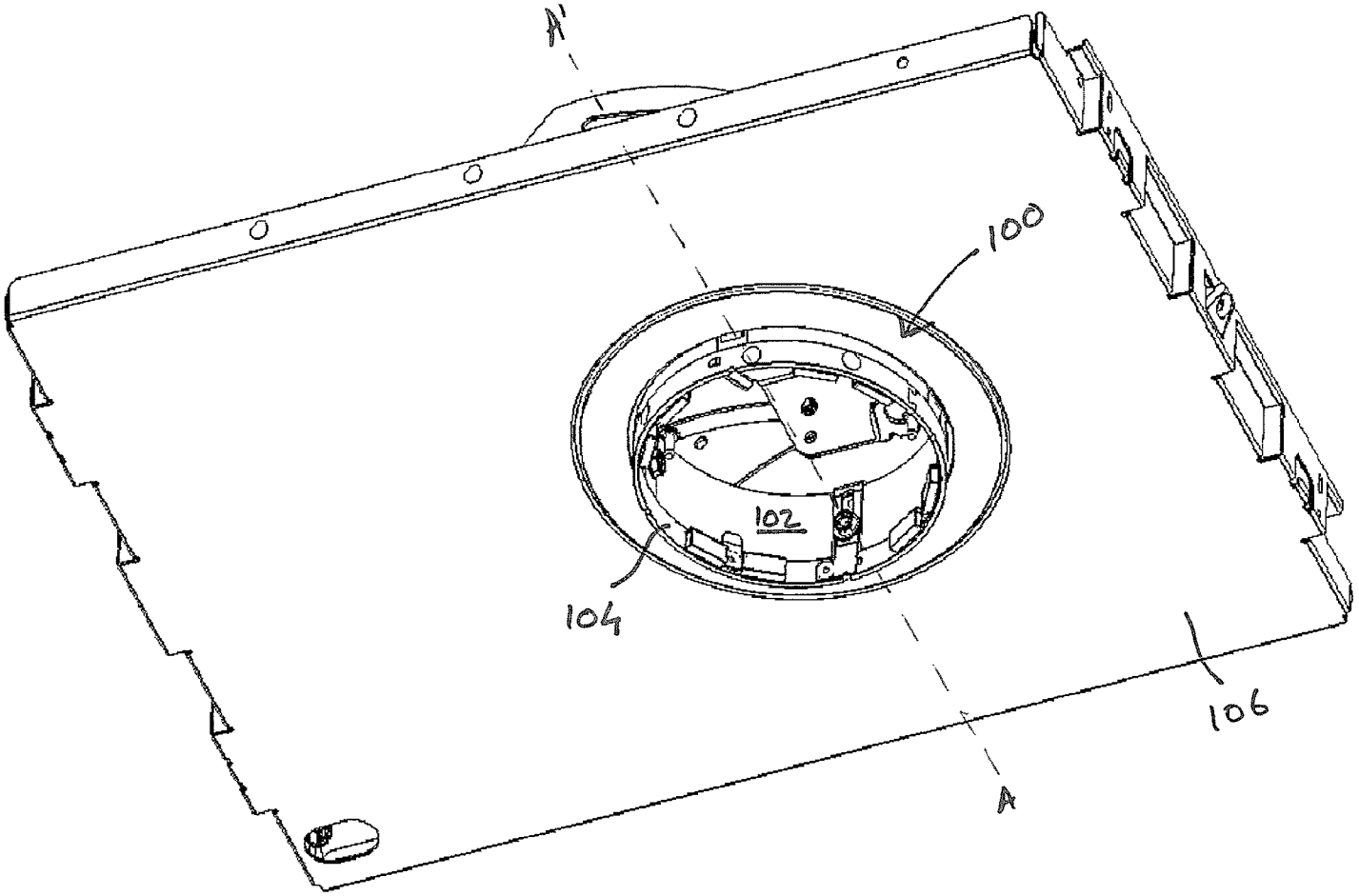
FIG. 1 illustrates a perspective view of a mounting system that is coupled to a plaster frame and is configured for installation of a rimmed finishing section in a recessed luminaire, in accordance with example embodiments of the present disclosure.
Figure 2:
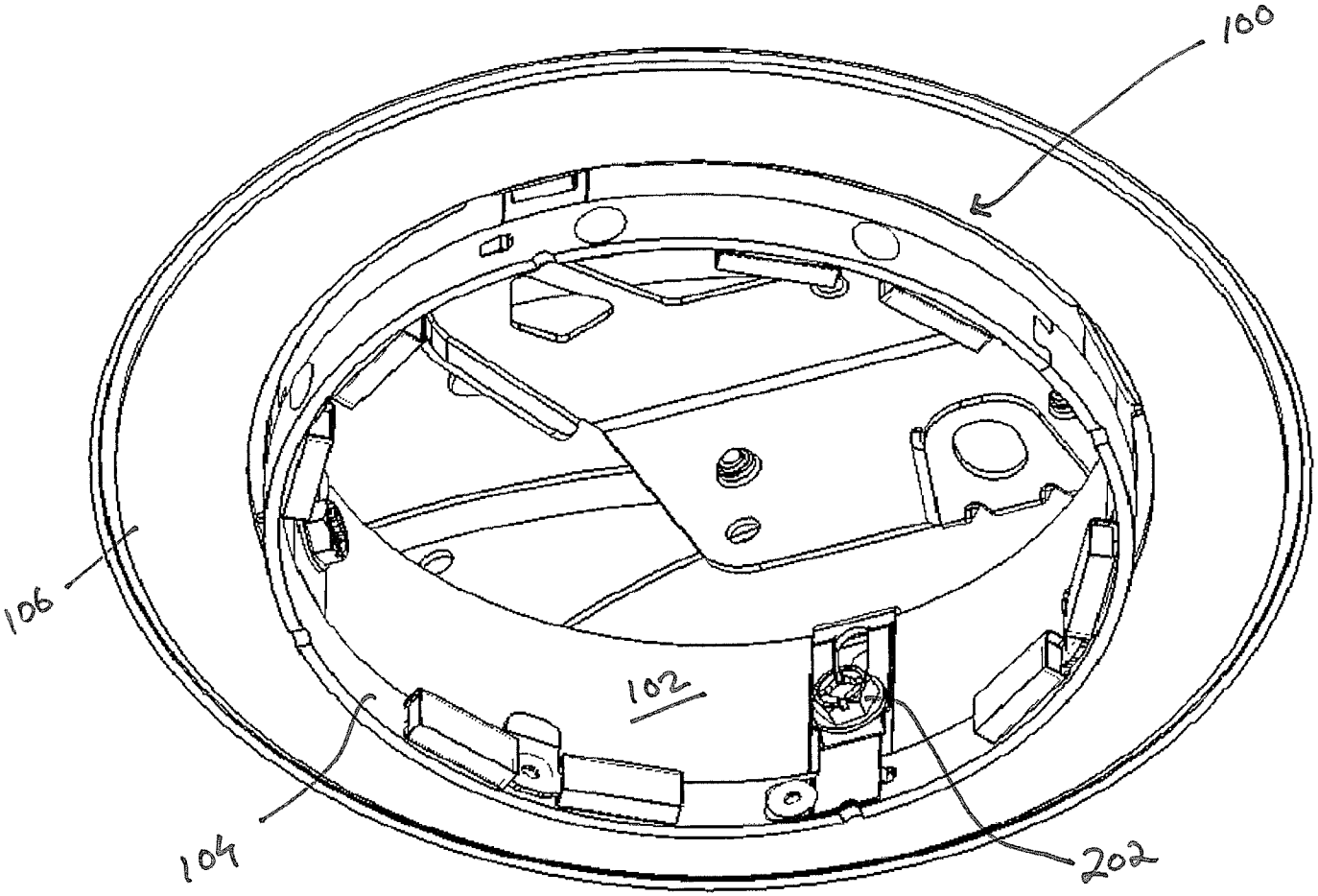
FIG. 2 illustrates an enlarged view of the mounting system of FIG. 1, in accordance with example embodiments of the present disclosure.
Figure 3:
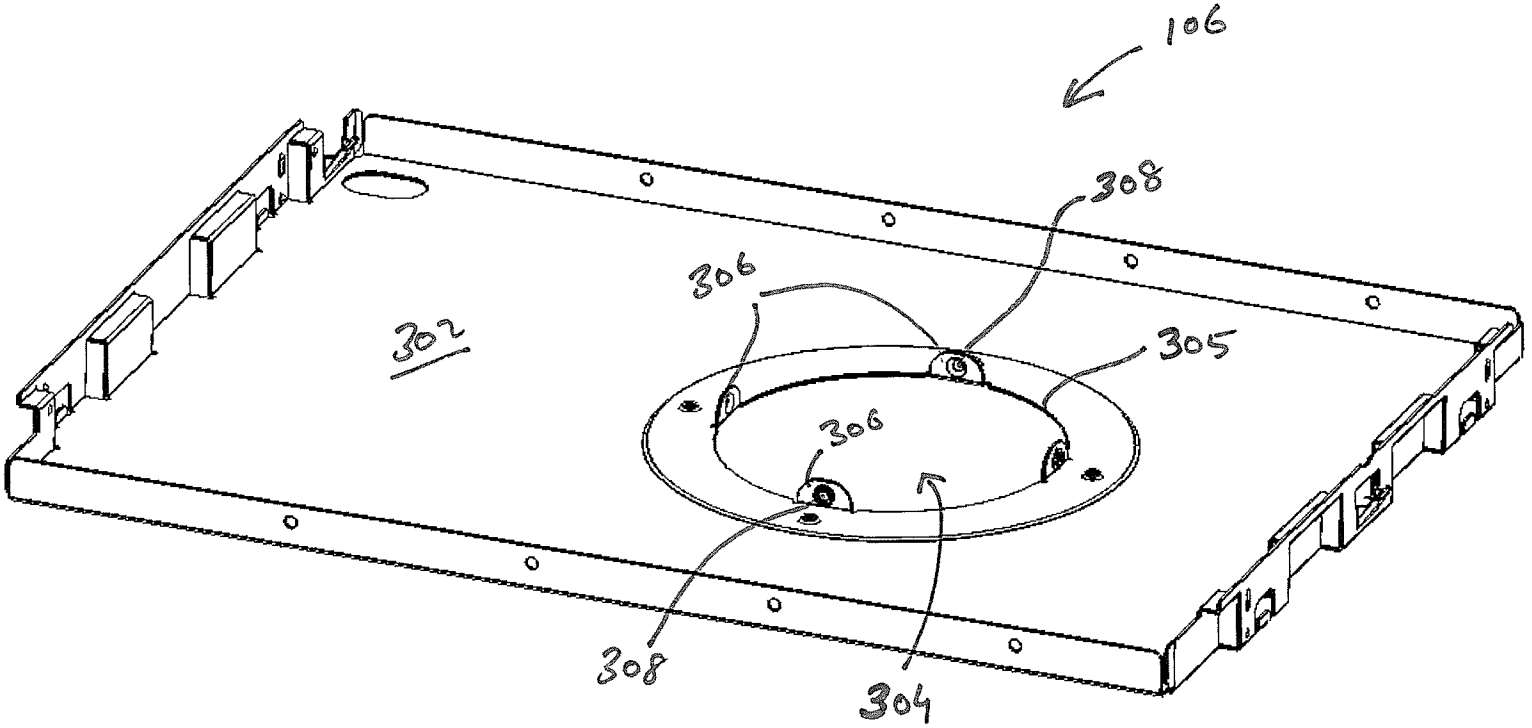
FIG. 3 illustrates a perspective view of a plaster frame to which the mounting system of FIG. 1 is configured to be coupled, in accordance with example embodiments of the present disclosure.
Figure 4:
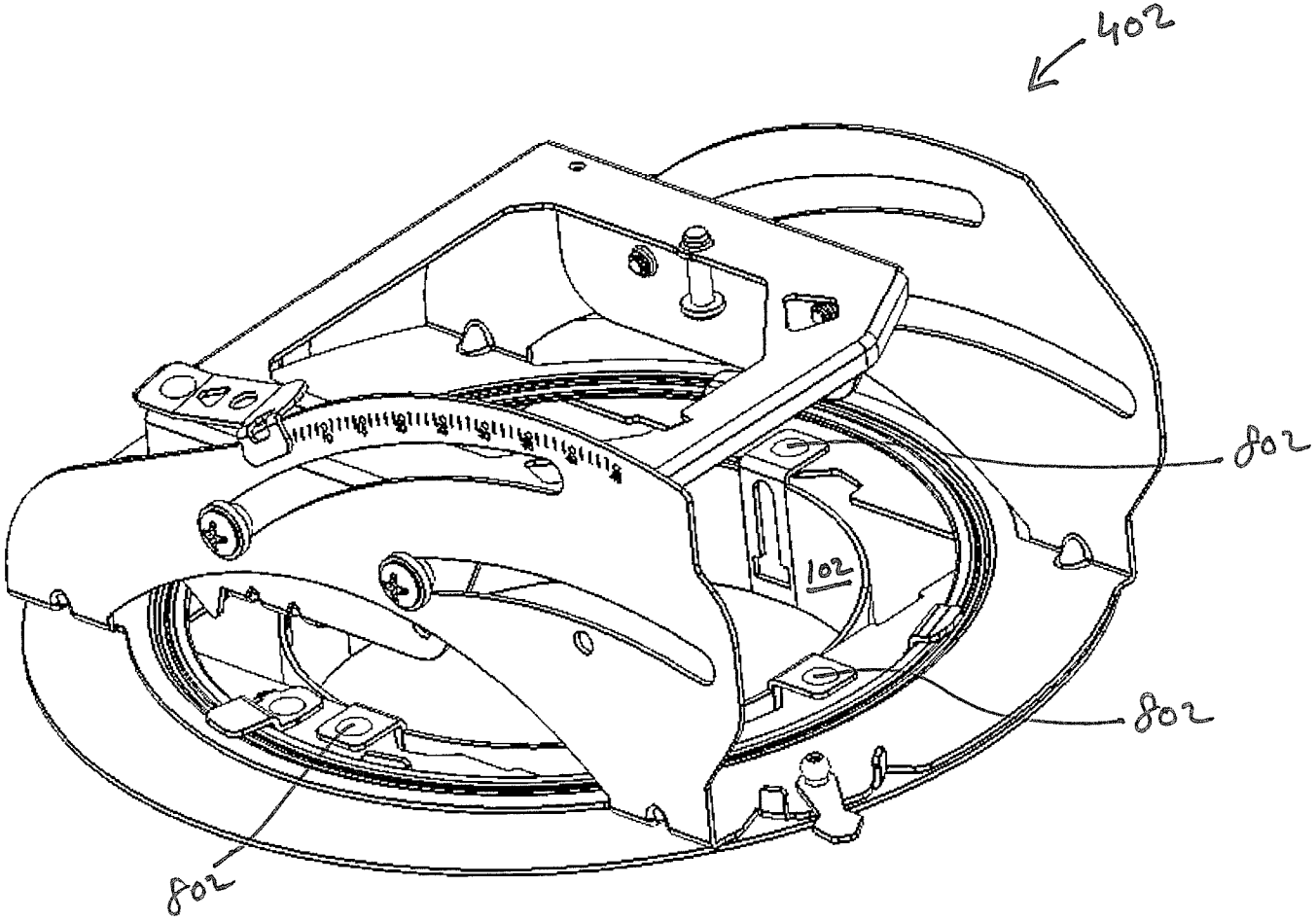
FIG. 4 illustrates a perspective view of a light engine mounting bracket comprising an upper collar of the mounting system of FIG. 1, in accordance with example embodiments of the present disclosure.
Figure 5:
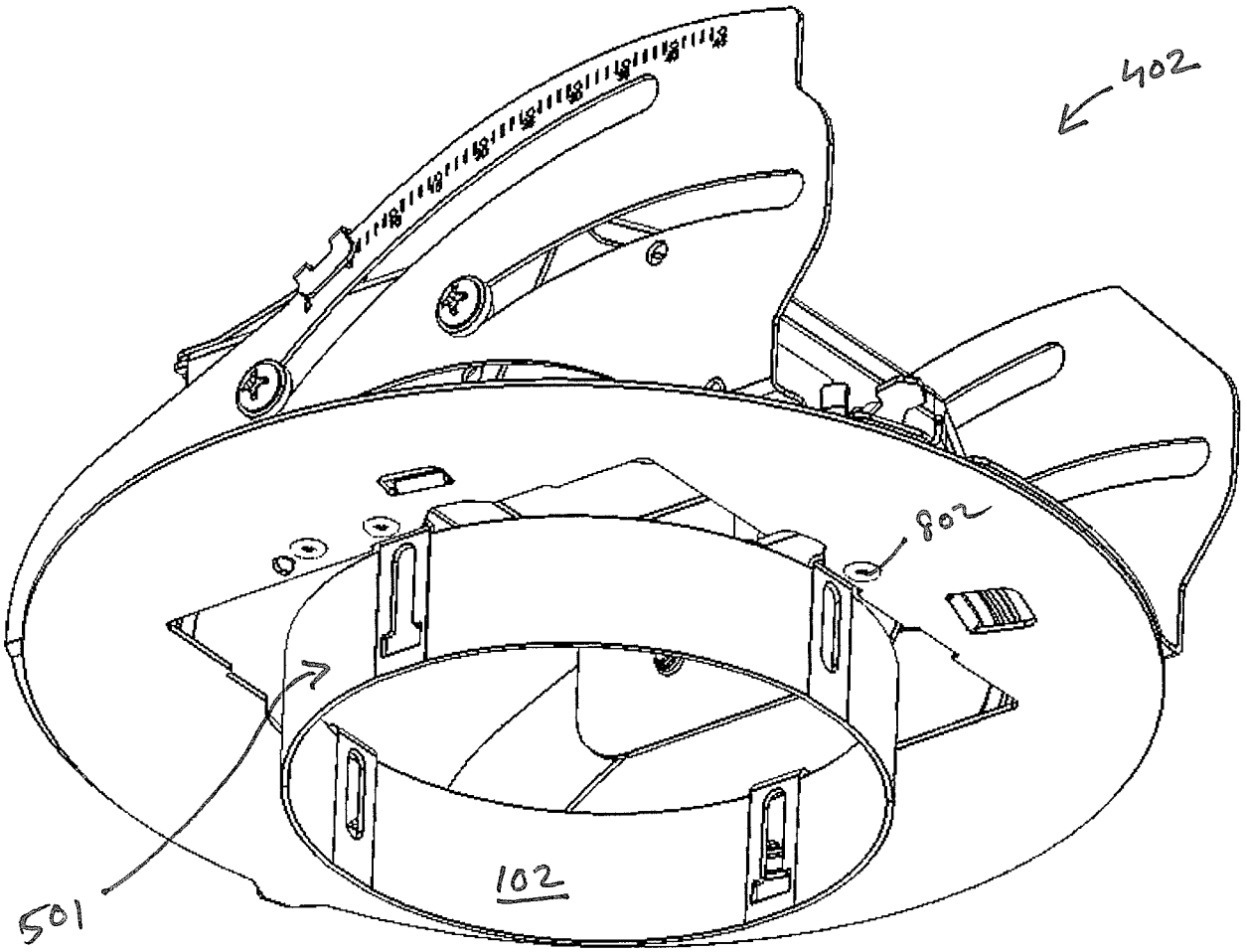
FIG. 5 illustrates another perspective view of a light engine mounting bracket comprising the upper collar of the mounting system of FIG. 1, in accordance with example embodiments of the present disclosure.

The drawings illustrate only example embodiments of the present disclosure and are therefore not to be considered limiting of its scope, as the present disclosure may admit to other equally effective embodiments. The elements and features shown in the drawings are not necessarily to scale, emphasis instead being placed upon clearly illustrating the principles of the example embodiments. Additionally, certain dimensions or positioning may be exaggerated to help visually convey such principles.

DETAILED DESCRIPTION OF EXAMPLE EMBODIMENTS

In the following paragraphs, a mounting system for magnetic installation of varying finishing sections in recessed luminaires will be described in further detail by way of examples with reference to the attached drawings. In the description, well known components, methods, and/or processing techniques are omitted or are briefly described so as not to obscure the disclosure. As used herein, the "present disclosure" refers to any one of the embodiments of the disclosure described herein and any equivalents. Furthermore, reference to various feature(s) of the "present disclosure" is not to suggest that all embodiments must include the referenced feature(s).

The mounting system of the present disclosure is configured to allow easy conversion from a rimmed installation of a recessed luminaire with a rimmed finishing section to a rimless installation of the recessed luminaire with a rimless finishing section or vice-versa without having to replace the entire luminaire or even the housing assembly of the luminaire. Further, the mounting system of the present disclosure may be configured to allow the finishing section (either rimmed or rimless) to be magnetically coupled to the recessed luminaire, thereby allowing easy replacement of the finishing sections as desired by the end user. Furthermore, the mounting system of the present disclosure may be configured to allow the installation of the recessed luminaire and the finishing sections within a range of ceiling thicknesses. The ability to use a single mounting system for installation of the recessed luminaire and the finishing sections within a range of ceiling thicknesses allows the manufacturer to significantly reduce the number of stock keeping units (SKUs) to a handful of base units that can cover the installation of the recessed luminaire and the finishing sections in ceilings of any appropriate range of thicknesses.

An example mounting system of the present disclosure may include a two-piece mounting collar that comprises: (a) an upper collar that is part of a light engine mounting bracket of a luminaire, and (b) a lower collar or a rimless adapter that is configured to be coupled to the upper collar. The lower collar is configured to be used with a rimmed finishing section, while the rimless adapter is configured to be used with a rimless finishing section. The light engine mounting bracket may be a bracket that is configured to retain a light engine of the luminaire above the ceiling and orient a light source of the light engine to emit light through an aperture in the ceiling to an area to be illuminated. In one example embodiment, the light engine mounting bracket may be an adjustable mounting bracket that allows the light engine to be tilted and aimed for providing adjustable lighting. However, in other example embodiments, the light engine mounting bracket may be a fixed mounting bracket that does not allow adjustability. In either case, the upper collar of the light engine mounting bracket may be disposed in the aperture that is formed in the ceiling for recessed lighting.

The two-piece mounting collar may be shipped from the factory for use with a rimmed finishing section. In other words, the two-piece mounting collar that is shipped from the factory may include a lower collar that comprises a first set of magnets to magnetically attach the rimmed finishing section in a lower mounting position. An end user that wishes to mount a rimless finishing section can remove the factory installed or supplied lower collar and replace it with the rimless adapter that may be shipped as an accessory. The rimless adapter includes a second set of magnets that are located at a higher position than the first set of magnets in the lower collar to magnetically attach the rimless finishing section in a higher mounting position compared to the lower mounting position of the rimmed finishing section. Both the lower collar and the rimless adapter are configured to be removably coupled to an upper collar of the light engine mounting bracket. The upper collar includes a slot that is configured to receive fasteners therethrough to couple the lower collar or rimless adapter to the upper collar. Further, the mounting system can be adjusted along the slot to mount the finishing section (rimmed or rimless) in ceilings having different thicknesses.

Moving now to discuss the figures, FIGS. 1-13 will describe an example embodiment of a mounting system that is configured to mount a rimmed finishing section to a recessed luminaire; FIGS. 14-19 will describe another example embodiment of the mounting system that is configured to mount a rimless finishing section to a recessed luminaire; and FIGS. 20-22 will describe a process of converting the mounting system from being configured to mount a rimmed finishing section to being configured to mount a rimless finishing section to the recessed luminaire and vice-versa.

Mounting System for Mounting a Rimmed Finishing Section to a Recessed Luminaire

Referring to FIGS. 1-12, an example mounting system 100 may include a two-piece mounting collar that comprises an upper collar 102 and a first lower collar 104 that is removably coupled to the upper collar 102. The mounting system 100 that is fitted with the first lower collar 104 may be configured to mount a rimmed finishing section 1102 (shown in FIG. 11) to a recessed luminaire (not shown in Figures).

In particular, the upper collar 102 may be part of a light engine mounting bracket 402 (shown in FIG. 4) that is configured to mount a light engine comprising a light source to the recessed luminaire. The recessed luminaire, the light engine, and the light source are not shown in the figures to avoid obscuring the elements of the mounting system 100. In one example embodiment, the light engine mounting bracket 402 may be configured to provide adjustability to the light engine. For example, the light engine mounting bracket 402 may be configured to allow the light engine to be tilted, rotated, and/or aimed such that a light emitted by the light source of the light engine can be directed as desired by an end user. However, in other example embodiments, the light engine mounting bracket may be fixed.

Figure 6:
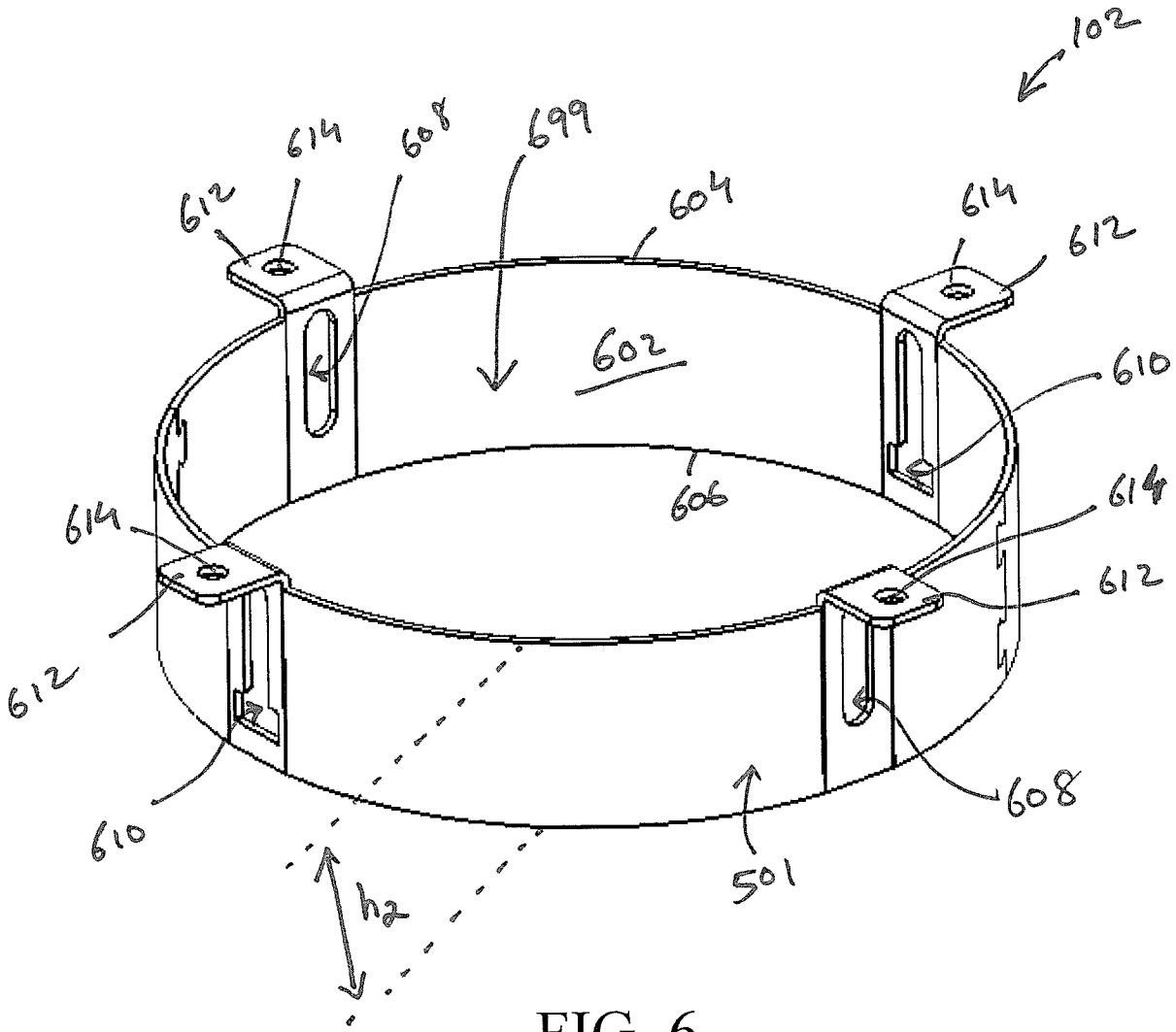
FIG. 6 illustrates a perspective view of the upper collar of the mounting system of FIG. 1, in accordance with example embodiments of the present disclosure.
Figure 8:
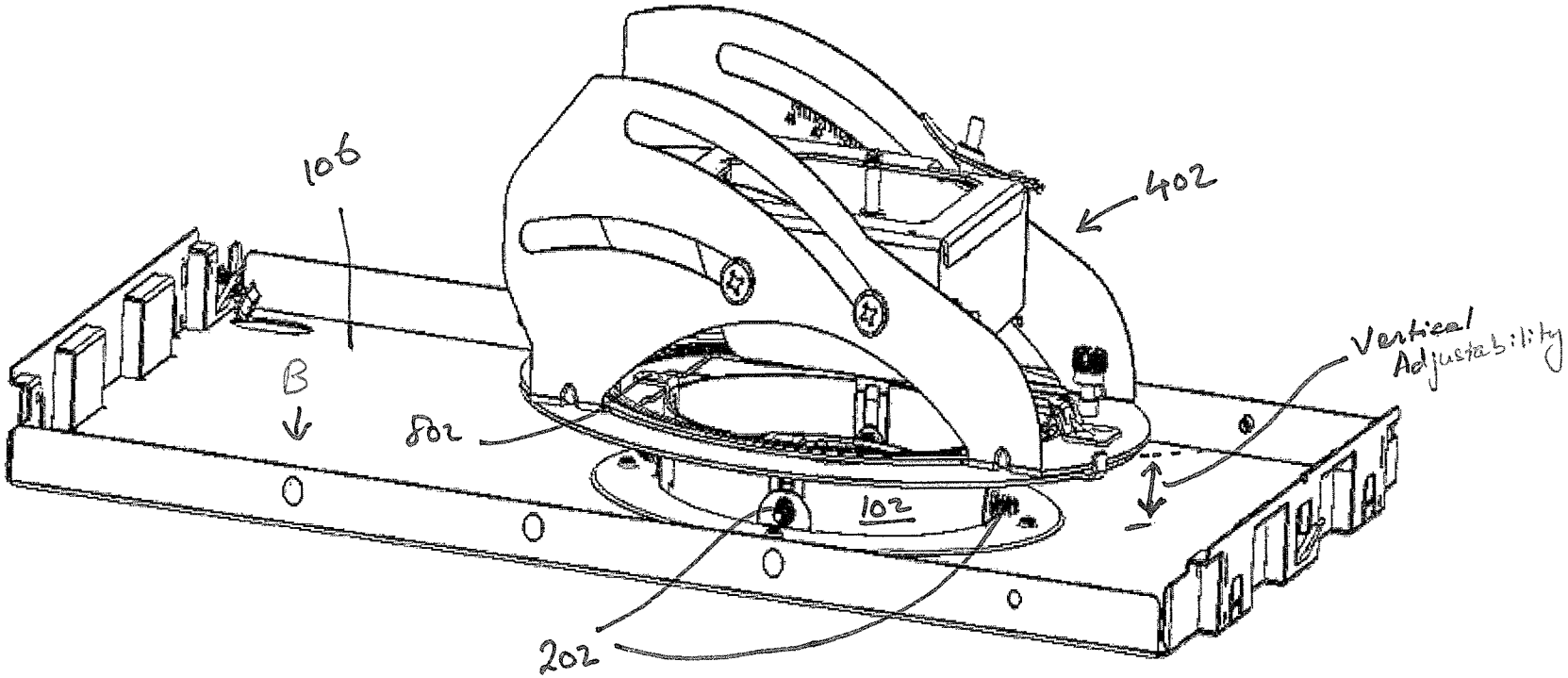
FIG. 8 illustrates another perspective view of the mounting system of FIG. 1 that is coupled to a plaster frame and is configured for installation of a rimmed finishing section in a recessed luminaire, in accordance with example embodiments of the present disclosure.
Figure 9:
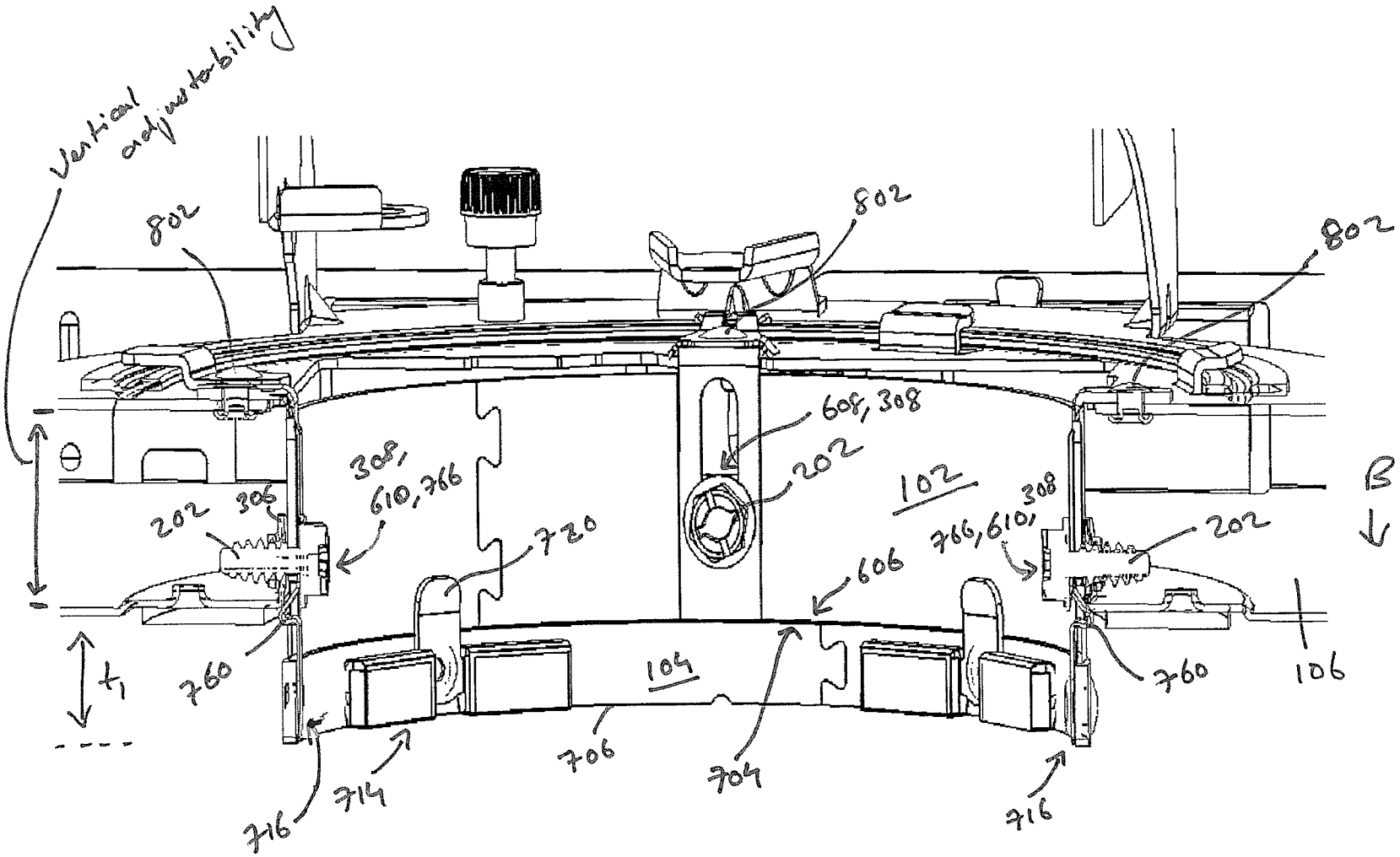
FIG. 9 illustrates an enlarged view of a cross-section of the mounting system of FIG. 1 along the A-A' axis, in accordance with example embodiments of the present disclosure.
Figure 10:
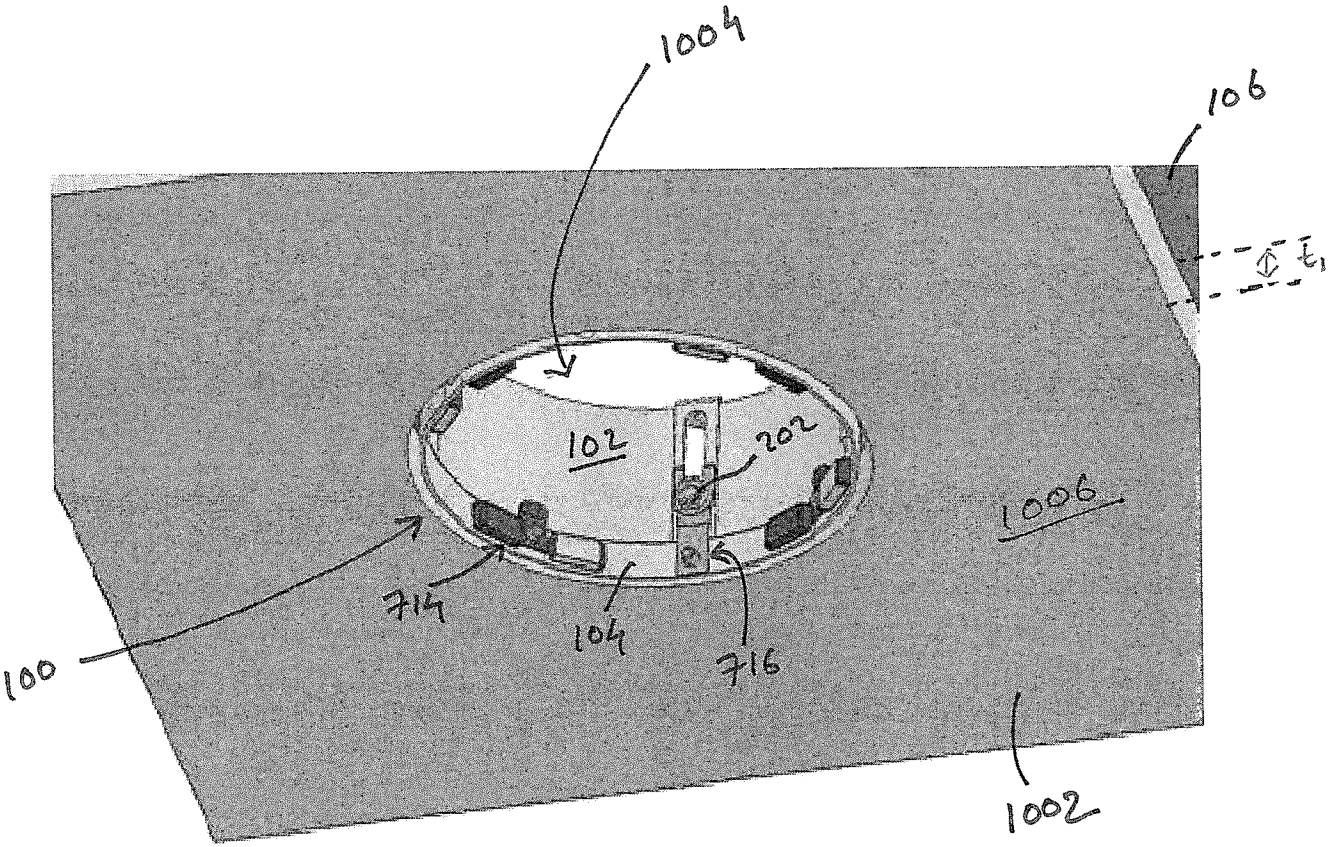
FIG. 10 illustrates a perspective view of the mounting system of FIG. 1 disposed in a ceiling, in accordance with example embodiments of the present disclosure.
Figure 12:
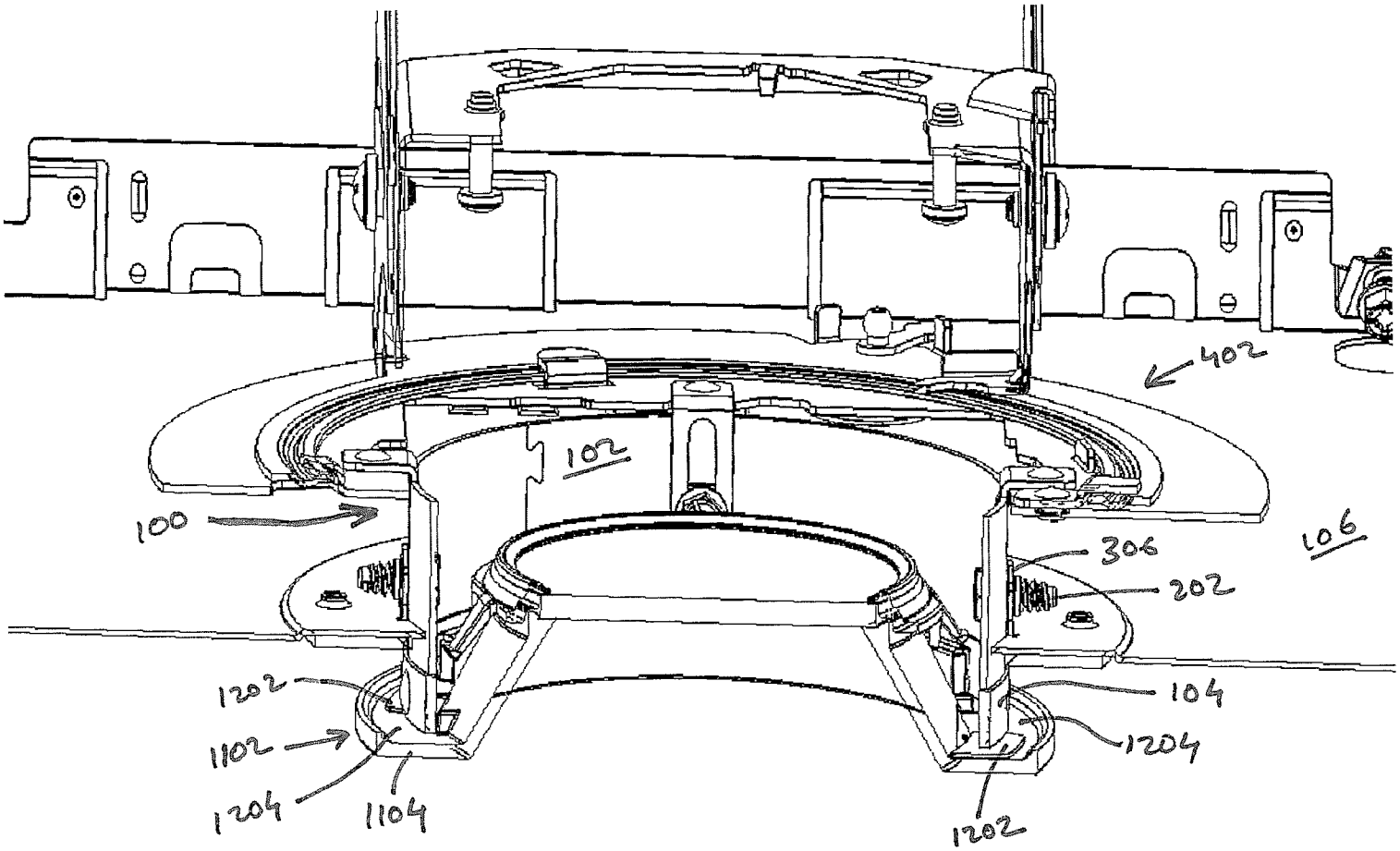
FIG. 12 illustrates an enlarged view of a cross-section of the mounting system of FIG. 1 with the rimmed finishing section coupled thereto, in accordance with example embodiments of the present disclosure.

As illustrated in FIG. 6, the upper collar 102 may include a first body 602 that is substantially ring shaped. The first body 602 of the upper collar 102 may extend from a first upper edge 604 to a first bottom edge 606 and may include one or more sets of through slots (608, 610) that are formed therein. Each slot of the first set of through slots 608 may be a substantially oblong or rounded rectangular shaped through slot, while each slot of the second set of through slots 610 may be a substantially inverted T-shaped through slot where the wider portion of the slot is disposed adjacent the first bottom edge 606 of the first body 602. Each slot of the first and second sets of through slots (608, 610) may extend from the first top edge 604 towards the first bottom edge 606. Further, the upper collar 102 may include coupling tabs 612 that extend radially outward and substantially perpendicular to the first body 602 from the first top edge 604 of the first body 602. The coupling tabs 612 may be aligned with the first and second set of through slots (608, 610) such that the coupling tabs 612 are disposed above a portion of the first body 602 comprising the first and second set of through slots (608, 610) as illustrated in FIG. 6. However, in other example embodiments, the coupling tabs 612 may not be aligned with the first and second set of through slots (608, 610). In either case, the coupling tabs 612 may include coupling holes 614 that are configured to receive fasteners 802 therethrough to attach the upper collar 102 to a portion of the light engine mounting bracket 402 as shown in FIGS. 8, 9, and 12.

In some example embodiments, the upper collar 102 may be coupled to the light engine mounting bracket 402 using any other appropriate coupling mechanisms without departing from a broader scope of the present disclosure. Even though the present disclosure describes the upper collar 402 as being coupled to or as being part of the light engine mounting bracket 402, one of skill in the art can understand and appreciate that in other example embodiments, the upper collar 102 may be independent of the light engine mounting bracket 402 (as an independent device) or may be coupled to any other component of the recessed luminaire without departing from a broader scope of the present disclosure.

Figure 7A:
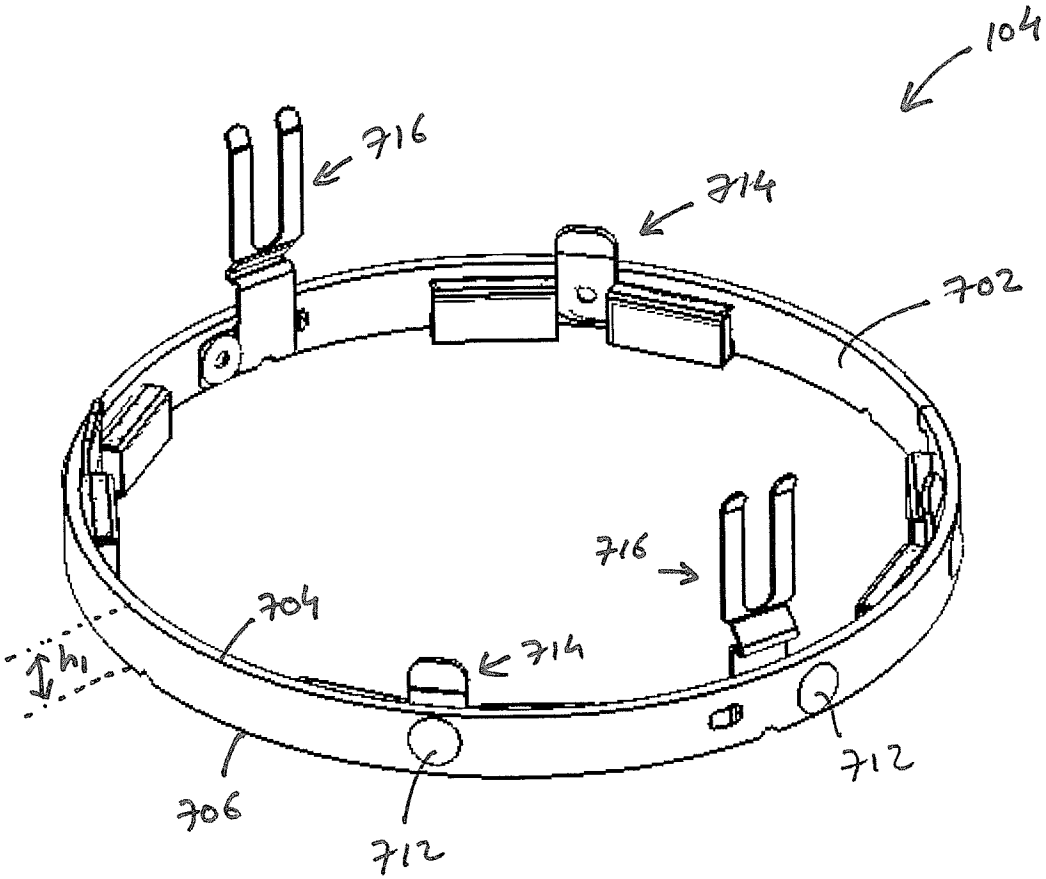
FIG. 7A illustrates a different perspective view of a first lower collar of the mounting system of FIG. 1, in accordance with example embodiments of the present disclosure.
Figure 7B:
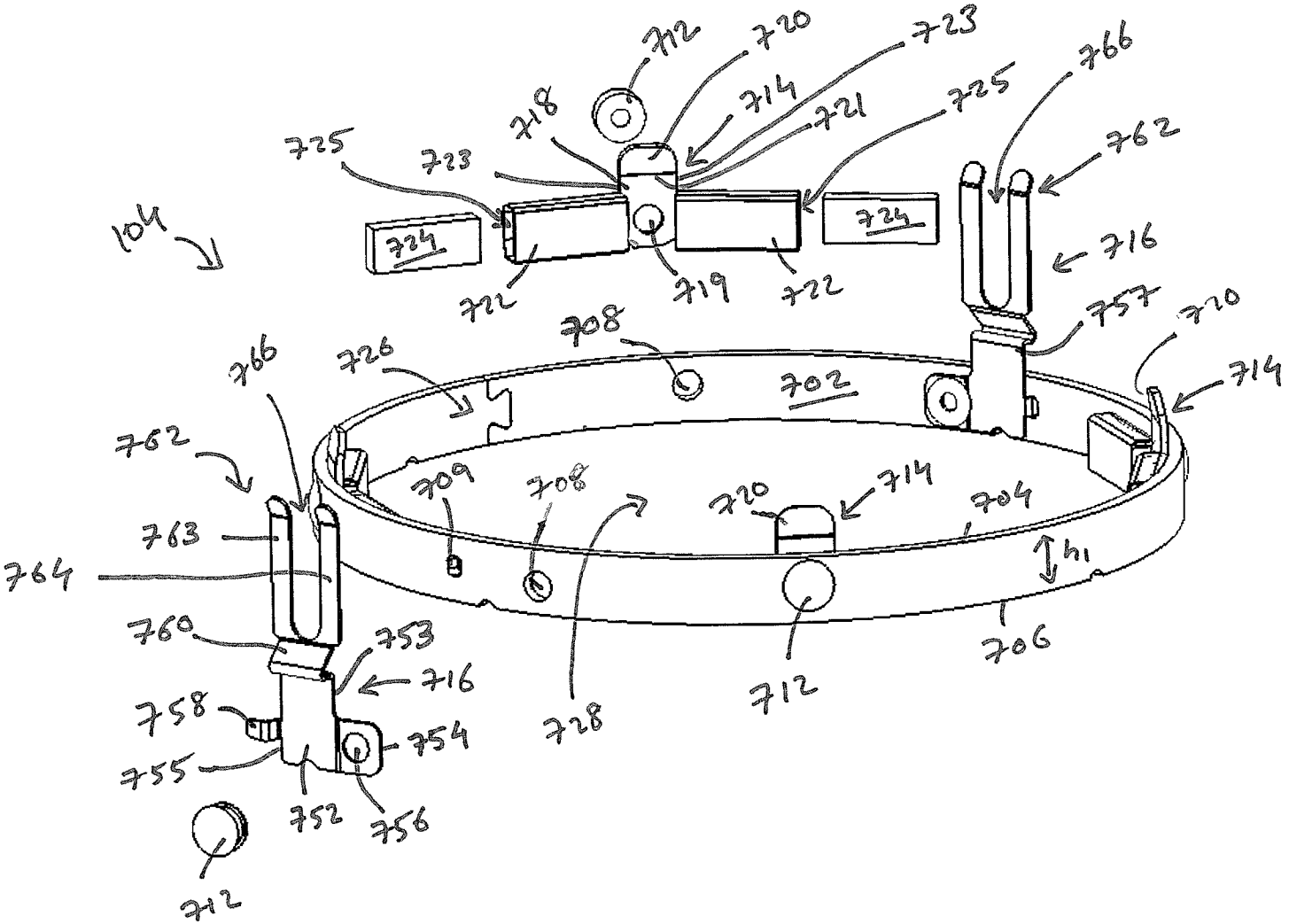
FIG. 7B illustrates a partially exploded view of the first lower collar of the mounting system of FIG. 1, in accordance with example embodiments of the present disclosure.

As illustrated in FIGS. 7A and 7B, the first lower collar 104 may include a second body 702 that is substantially ring shaped. The second body 702 may extend from a second top edge 704 to a second bottom edge 706. The height 'h1' of the second body 702 associated with the first lower collar 104 (measured from second top edge 704 to the second bottom edge 706) may be lesser than the height 'h2' of the first body 602 associated with the upper collar 102 (measured from first top edge 604 to the first bottom edge 606). The second body 702 of the first lower collar 104 may include coupling apertures 708 that are configured to receive fasteners 712 therethrough to couple magnet housing brackets 714 and coupling members 716 to the second body 702.

Each magnet housing bracket 714 may be include a middle segment 718 that comprises a coupling opening 719 that is formed therein and configured to receive a fastener 712 therethrough to couple the magnet housing bracket 714 to the second body 702 of the first lower collar 104. Further, each magnet housing bracket 714 may include a guiding tab 720 that extends upwards from an upper edge 721 of the middle segment 718 and at an obtuse inner angle to the middle segment 718. Furthermore, each magnet housing bracket 714 may include two side arm assemblies 722, each extending outward from opposing side edges 723 of the middle segment 718. Each side arm assembly 722 defines a magnet housing that is configured to house a magnet 724 therein. In particular, the magnet 724 may be disposed in a magnet housing cavity 725 that is defined by the side arm assembly 722. Each magnet housing bracket 714 may be configured to house two magnets 724 since the magnet housing bracket 714 comprises two side arm assemblies 722 that defines two magnet housing cavities 725.

The magnet housing bracket 714 may be coupled to the second body 702 of the first lower collar 104 using fasteners 712 as illustrated in FIGS. 7A and 7B. In particular, the magnet housing bracket 714 may be placed against an inner surface 726 of the second body 702 such that: (a) the coupling opening 719 of the magnet housing bracket 714 is axially aligned with a coupling aperture 708 of the second body 702, (b) the guiding tab 720 extends into a central opening 728 defined by the second body 702, and (c) the side arm assemblies 722 that define the magnet housings and comprise the magnets 724 therein are disposed in the central opening 728 and adjacent the second bottom edge 706 of the second body 702. Further, a fastener 712 is passed through the axially aligned coupling opening 719 of the magnet housing bracket 714 and the coupling aperture 708 of the second body 702 to couple the magnet housing bracket 714 to the second body 702 of the first lower collar 104.

Even though each magnet housing bracket 714 of the present disclosure is configured to house two magnets 724, one of skill in the art can understand and appreciate that in other example embodiments, a magnet housing bracket 714 may be configured to house fewer or more magnets. Further, in other example embodiments, the magnet housing bracket 714 can have any other appropriate shape, but remain functionally similar without departing from a broader scope of the present disclosure. Furthermore, in other example embodiments, the magnet housing bracket 714 may be integrated with the second body 702 of the first lower collar 104 without departing from a broader scope of the present disclosure.

Further, as illustrated in FIG. 7B, each coupling member 716 may include a base segment 752 and an attachment tab 754 extending radially outward from a side edge 753 of the base segment 752. The attachment tab 754 may include an attachment opening 756 formed therein to receive a fastener 712 therethrough to couple the coupling member 716 to the second body 702 of the first lower collar 104 as illustrated in FIG. 7A. Further, the coupling member 716 may include a tongue 758 that is substantially L-shaped and extending from an opposite side edge 755 of the base segment 752. The tongue 758 may be configured to be inserted through an attachment aperture 709 of the second body 702 to couple the coupling member 716 to the second body 702 of the first lower collar 104 as illustrated in FIG. 7A. Furthermore, the coupling member 716 may include a snap fit protrusion 760 that is substantially V-shaped and that extends upward from an upper edge 757 of the base segment 752. Additionally, the coupling member 716 may include a two-prong fork arm assembly 762 that comprises a first arm 763 and a second arm 764 that extend upward from an upper edge 761 of the snap fit protrusion 760. The two-prong fork arm assembly 762 may define an attachment slot 766 that is substantially U-shaped and open at one end as illustrated in FIGS. 7A and 7B.

The coupling member 716 may be coupled to the second body 702 of the first lower collar 104 using fasteners 712 and the tongue 758 as illustrated in FIGS. 7A and 7B. In particular, the tongue 758 of the coupling member 716 may be inserted into the attachment aperture 709 of the second body 702 such that: (a) the coupling member 716 is placed against the inner surface 726 of the second body 702, (b) the attachment opening 756 on the attachment tab 754 of the coupling member 716 is axially aligned with a coupling aperture 708 of the second body 702, and (c) the snap fit protrusion 760 and the fork arm assembly 762 extends above the second top edge 704 of the second body 702. Further, a fastener 712 is passed through the axially aligned attachment opening 756 on the attachment tab 754 of the coupling member 716 and the coupling aperture 708 of the second body 702 to couple the coupling member 716 to the second body 702 of the first lower collar 104.

Even though the present disclosure describes the first lower collar 104 as comprising two coupling members 716 and four magnet housing brackets 714, one of skill in the art can understand and appreciate that in other example embodiments, the first lower collar 104 may include fewer or more number of coupling members 716 and magnet housing brackets 714 without departing from a broader scope of the present disclosure.

As illustrated in FIGS. 1, 2, 8, 9, and 10, the mounting system 100 may be coupled to a plaster frame 106. The plaster frame 106 may include a base 302 and a light engine receiving aperture 304 formed therein. Further, the plaster frame 106 may include a plurality of mating tabs 306 disposed along an edge 305 of the plaster frame 106 that defines a perimeter of the light engine receiving aperture 304. Each mating tab 306 may include a mating aperture 308 that is formed therein. The mating aperture 308 of each mating tab 306 may be configured to receive a fastener 202 threrethrough to couple the mounting system 100 to the plaster frame 106.

In particular, the plaster frame 106 may be disposed on a ceiling 1002 (shown in FIG. 10) such that the light engine receiving aperture 304 that is formed in the base 302 of the plaster frame 106 is axially aligned with a light emitting opening 1004 that is formed in the ceiling 1002. Further, the upper collar 102 may be positioned within the axially aligned light engine receiving aperture 304 of the plaster frame 106 and the light emitting opening 1004 of the ceiling 1002 such that: (a) an outer surface 501 of the upper collar 102 engages the edge of the ceiling 1002 (along its thickness) that defines the light emitting opening 1004, the edge of the plaster frame 106 that defines a perimeter of the light engine receiving aperture 304, and the mating tabs 306 of the plaster frame 106; and (b) the first and second set of through slots (608, 610) of the upper collar 102 axially align with the mating apertures 308 of the mating tabs 306 on the plaster frame 106.

Furthermore, the first lower collar 104 may be positioned below and axially aligned with the upper collar 102 and pushed towards the upper collar 102 and adjusted until: (a) the second top edge 704 of the first lower collar 104 engages the first bottom edge 606 of the upper collar 102, (b) the snap fit protrusion 760 on the coupling member 716 of the first lower collar 104 snaps into a wider part of the second set of through slots 610 on the upper collar 102 that defines a snap-in area, and (c) the attachment slots 766 defined by the coupling member 716 of the first lower collar 104 are aligned with the axially aligned second set of through slots 610 of the upper collar 102 and the mating apertures 308 of the mating tabs 306 on the plaster frame 106. The guiding tabs 720 may be configured to guide the first lower collar 104 to be coupled to the upper collar 102 and align the first lower collar 104 with the upper collar 102.

Once the mounting system 100 is positioned as described above, fasteners 202 may be passed through: (a) the axially aligned first set of through slots 608 of the upper collar 102 and the mating apertures 308 of the mating tabs 306 on the plaster frame 106, and (b) the axially aligned attachment slots 766 of the first lower collar 104, the second set of through slots 610 of the upper collar 102, and the mating apertures 308 of the mating tabs 306 on the plaster frame 106 to couple the mounting system 100 to the plaster frame 106 and dispose the mounting system 100 within the light emitting opening 1004 of the ceiling 1002.

The mounting system 100 may be disposed in the light emitting opening 1004 of the ceiling 1002 such that: (a) a combination of the height 'h2' of the first lower collar 104 and at least a portion of the height 'h1' of the upper collar 102 covers the thickness 't1' of the ceiling 1002 (shown in FIGS. 9 and 10), and (b) the magnets 724 carried by the first lower collar 104 are disposed within the light emitting opening 1004 and adjacent a bottom surface 1006 of the ceiling 1002.

As illustrated in FIGS. 8 and 9, the mounting system 100 may be coupled to the plaster frame 106 such that the mounting system 100 can be adjusted vertically to fit within different ceilings having a range of thicknesses. For example, if the ceiling 1002 had a thickness 't2' that is greater than the thickness 't1', then, the mounting system 100 may be fitted within the ceiling 1002 having the greater thickness 't2' by: (a) removing the fasteners 202, (b) moving the mounting system 100 further down towards the direction of the plaster frame 106 (direction B) (shown in FIGS. 8 and 9) till the combination of the height 'h2' of the first lower collar 104 and at least a portion of the height 'h1' of the upper collar 102 covers the thickness 't2' of the ceiling 1002, and passing the fasteners 202 through the axially aligned first set of through slots 608 of the upper collar 102 and the mating apertures 308 of the mating tabs 306 on the plaster frame 106, and the axially aligned attachment slots 766 of the first lower collar 104, second set of through slots 610 of the upper collar 102, and the mating apertures 308 of the mating tabs 306 on the plaster frame 106. In other words, the mounting system 100 is configured to be vertically adjustable (both up and down) by sliding along the axially aligned attachment slots 766 of the first lower collar 104 and second set of through slots 610 of the upper collar 102 to accommodate installation of the mounting system 100 within a range of ceiling thicknesses, e.g., ¾ inch to ⅞ inch; and so on. In one example, the fasteners 202 may be positioned at a lower end of the axially aligned attachment slots 766 of the first lower collar 104 and second set of through slots 610 of the upper collar 102 (adjacent the first bottom edge 606 of the upper collar 102) to install the mounting system 100 in a ceiling that has a thickness that is at the lower end of the range of ceiling thicknesses, e.g., thinner ceilings. Similarly, the fasteners 202 may be positioned at a top end of the axially aligned attachment slots 766 of the first lower collar 104 and second set of through slots 610 of the upper collar 102 (adjacent the first top edge 604 of the upper collar 102) to install the mounting system 100 in a ceiling that has a thickness that is at the upper end of the range of ceiling thicknesses, e.g., thicker ceilings.

Figure 13:
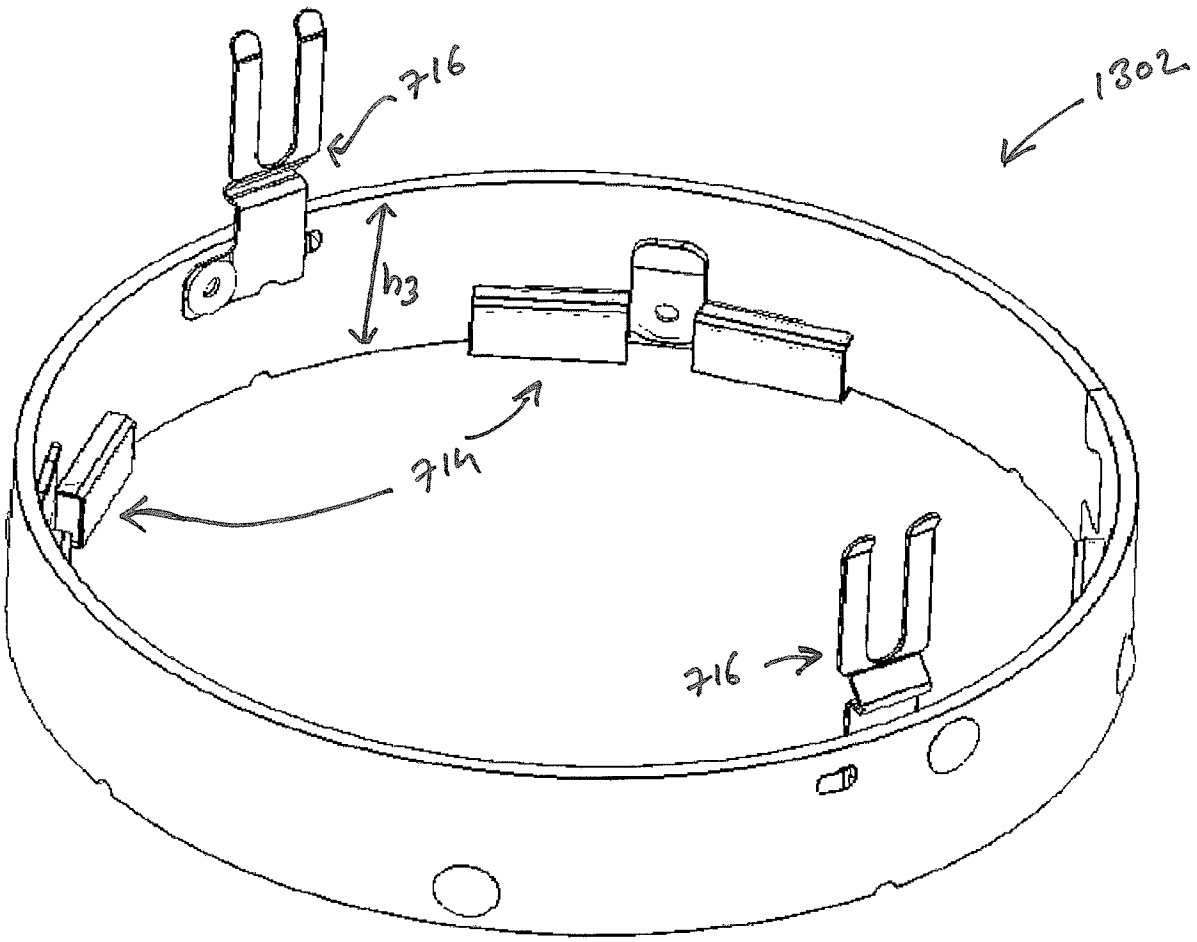
FIG. 13 illustrates a perspective view of a tall lower collar of the mounting system, in accordance with example embodiments of the present disclosure.

In some example embodiments where the thickness of the ceiling is above a higher end of a range of ceiling thickness for which the mounting system 100 is designed, the first lower collar 104 of the mounting system 100 can be removed and replaced with a tall lower collar 1302 (shown in FIG. 13). The tall lower collar 1302 may be substantially similar to the first lower collar 104 except that: (a) a height 'h3' of the tall lower collar 1302 may be greater than the height 'h2' of the first lower collar 104, and (b) the coupling members 716 may be positioned adjacent a top edge of the body of the tall lower collar 1302, while the magnet housing brackets 714 and the magnets 724 housed therein are disposed adjacent the bottom edge of the body of the tall lower collar 1302. The first lower collar 104 may be replaced with the tall lower collar 1302 by: (a) removing the fasteners 202 that couple the first lower collar 104 to the upper collar 102, (b) replacing the first lower collar 104 with the tall lower collar 1302, and (c) passing the fasteners 202 through the axially aligned second set of through slots 610 of the upper collar 102 and the attachment slots 766 defined by the coupling member 716 of the tall lower collar 1302. Similar to the first lower collar 104, the top edge of the tall lower collar 1302 may engage the first bottom edge 606 of the upper collar 104, and the snap fit protrusion 760 on the coupling member 716 of the tall lower collar 1302 snaps into a wider part of the second set of through slots 610 on the upper collar 102.

Figure 11:
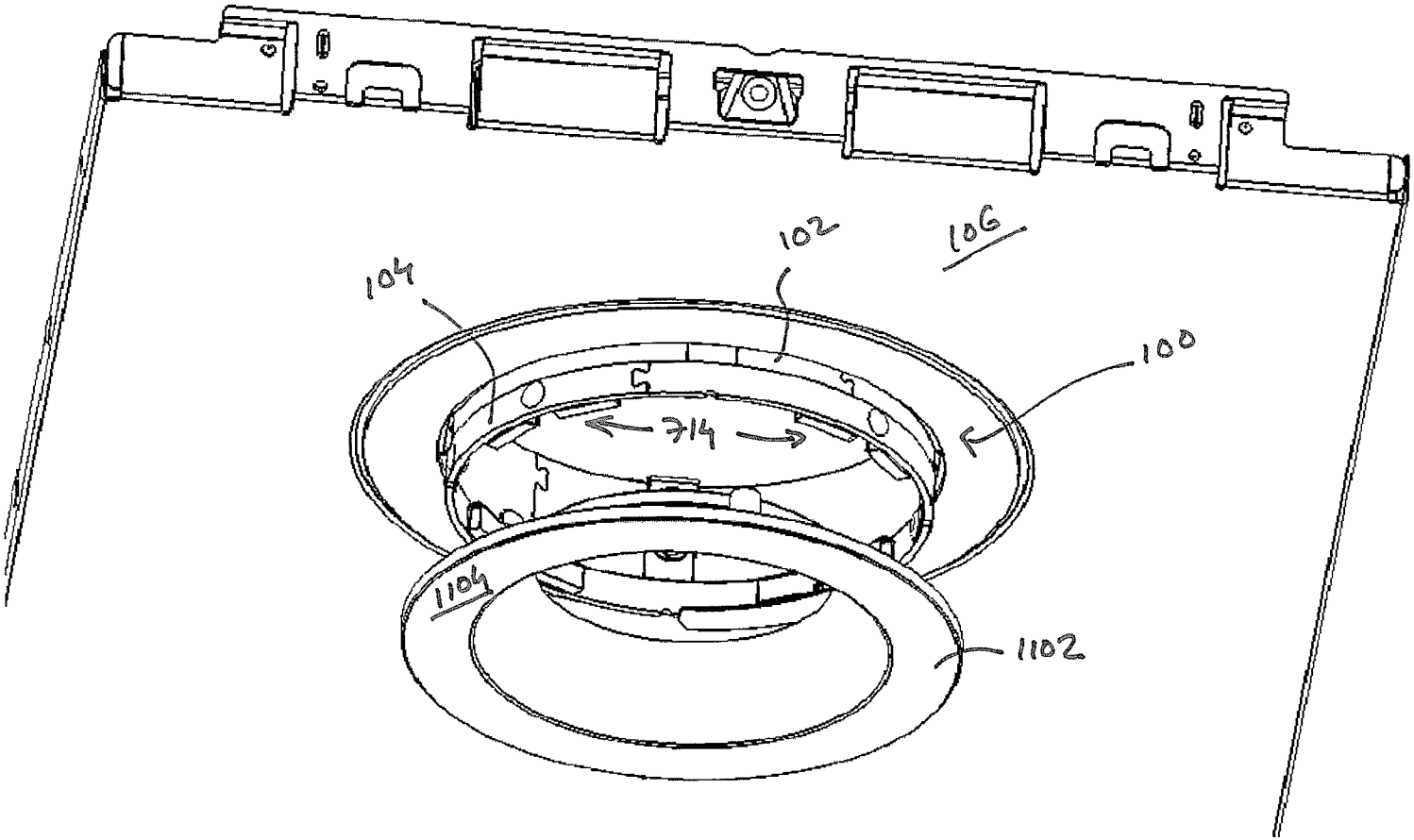
FIG. 11 illustrates an enlarged view of the mounting system of FIG. 1 that is coupled to the plaster frame and a rimmed finishing section that is configured to be installed in a recessed luminaire via the mounting system of FIG. 1, in accordance with example embodiments of the present disclosure.

The mounting system 100 comprising either the first lower collar 104 or the tall lower collar 1302 may be configured for coupling a rimmed finishing section 1102 to the recessed luminaire as illustrated in FIG. 11. The rim 1104 of the rimmed finishing section 1102 may include a plurality of magnetic plates 1202 (shown in FIG. 12) that are configured to magnetically couple the rimmed finishing section 1102 to the recessed luminaire via the complementary magnets 724 housed in the first lower collar 104 of the mounting system 100. The plurality of magnetic plates 1202 may be attached to a top surface 1204 of the rim 1104 of the rimmed finishing section 1102 using adhesives or any other appropriate coupling mechanisms. In particular, an end user may position the rimmed finishing section 1102 below the ceiling 1002 such that the rimmed finishing section 1102 is axially aligned with the light emitting opening 1004 of the ceiling 1002 and the plurality of magnetic plates 1202 are aligned with the magnets 724 housed within the magnet housing brackets 714 of the first lower collar 104. Responsively, as illustrated in FIG. 12, the magnets 724 housed within the magnet housing brackets 714 of the first lower collar 104 attract the complementary plurality of magnetic plates 1202 disposed on the rim 1104 of the rimmed finishing section 1102, which in turn pulls the rimmed finishing section 1102 up towards the ceiling 1002 till the rim 1104 of the rimmed finishing section 1102 engages the bottom surface 1006 of the ceiling 1002. The second bottom edge 706 of the first lower collar 104 may engage the plurality of magnetic plates 1202 disposed on the top surface 1204 of the rim 1104 of the rimmed finishing section 1102, when the rimmed finishing section 1102 is coupled to the mounting system 100.

Even though FIGS. 1-13 describe a mounting system 100 that is configured to mount a rimmed finishing section 1102 to a recessed luminaire, one of ordinary skill in the art can understand and appreciate that in other example embodiments where a rimless appearance is preferred, the mounting system 100 can be modified to mount a rimless finishing section to the recessed luminaire without departing from a broader scope of the present disclosure. For example, as illustrated in FIGS. 14-22 the first lower collar 104 of the mounting system 100 may be replaced with a second lower collar 1402 that is configured to mount a rimless finishing section 1802 to a recessed luminaire.

Mounting System for Mounting a Rimless Finishing Section to a Recessed Luminaire Referring to FIGS. 14-19, the second lower collar 1400 may include third body 1402 that is coupled to a lathing ring 1404. The third body 1402 may be substantially ring shaped and may extend from a third top edge 1406 to an intermediate edge 1408. Further, the third body 1402 may include a lip 1410 that extends radially outward from intermediate edge 1408, and a flange 1412 that extends downward, away from, and substantially perpendicular to the lip 1410 from an outer edge of the lip 1410 to a third bottom edge 1409. The height 'h4' of the third body 1402 (from the third top edge 1406 to the third bottom edge 1409) may be greater than the height 'h1' of the first lower collar 104.

Figure 15:
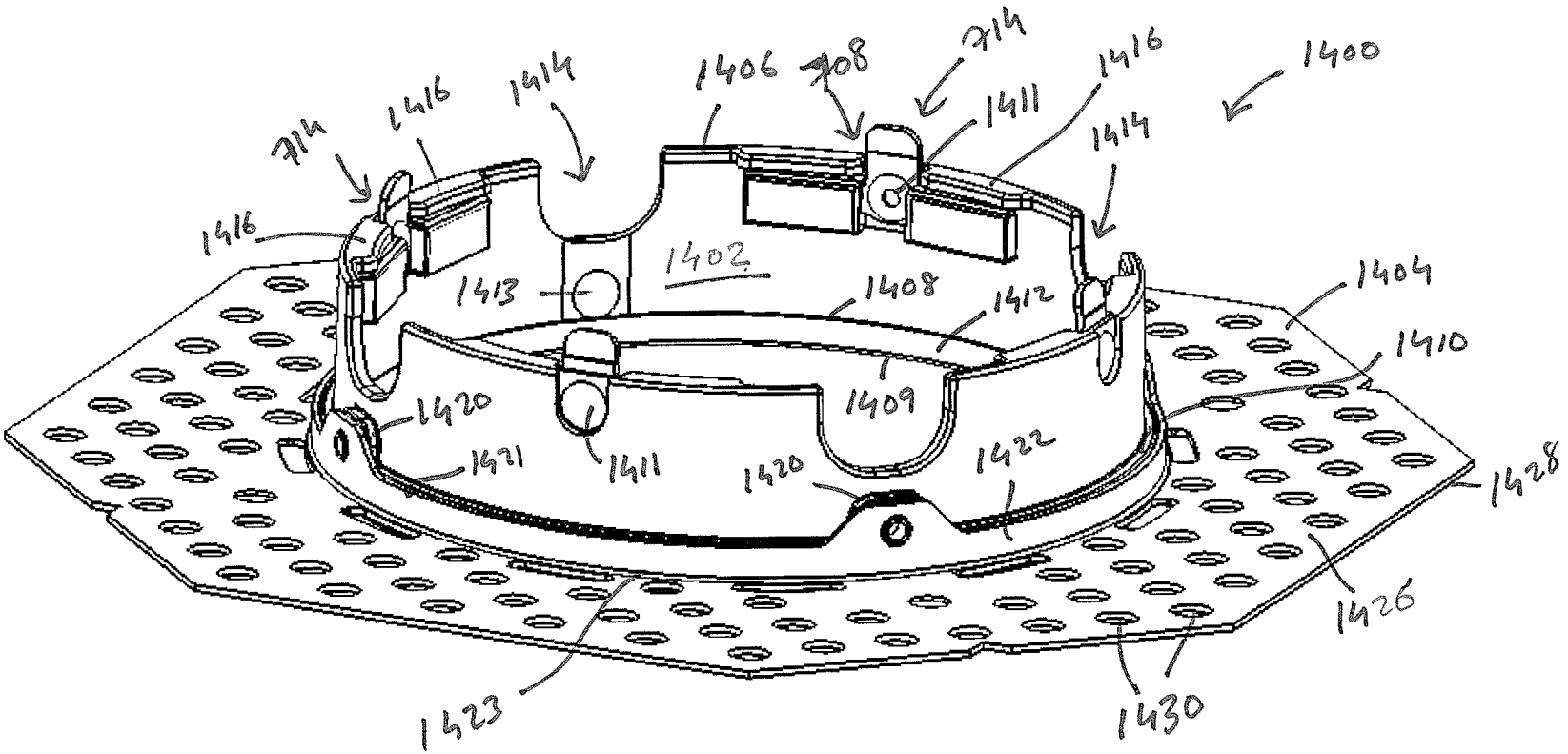
FIG. 15 illustrates another perspective view of the second lower collar of the mounting system of FIG. 1, in accordance with example embodiments of the present disclosure.
Figure 16:
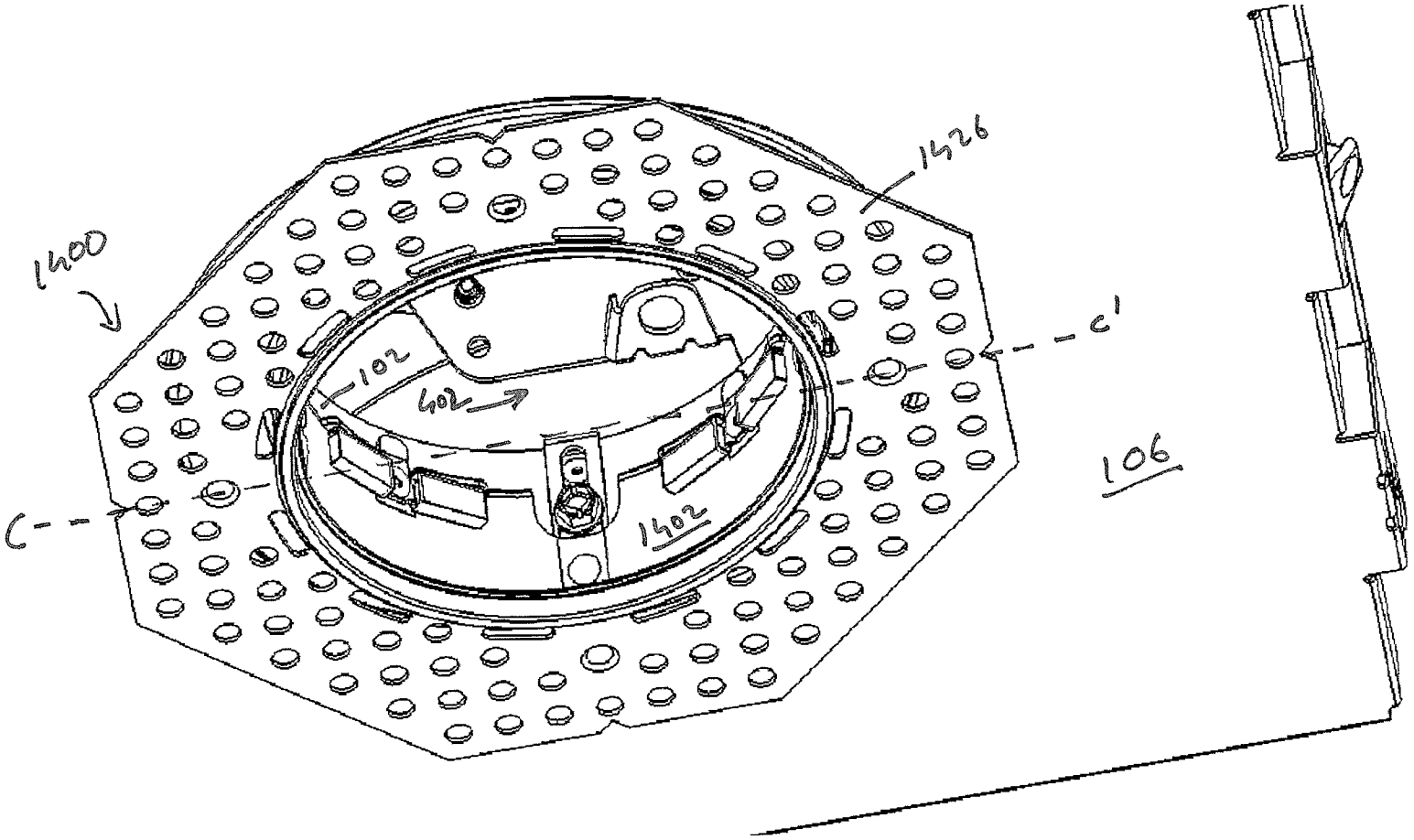
FIG. 16 illustrates a perspective view of a mounting system that comprises the second lower collar that is configured for installation of a rimless finishing section in a recessed luminaire, in accordance with example embodiments of the present disclosure.
Figure 17:
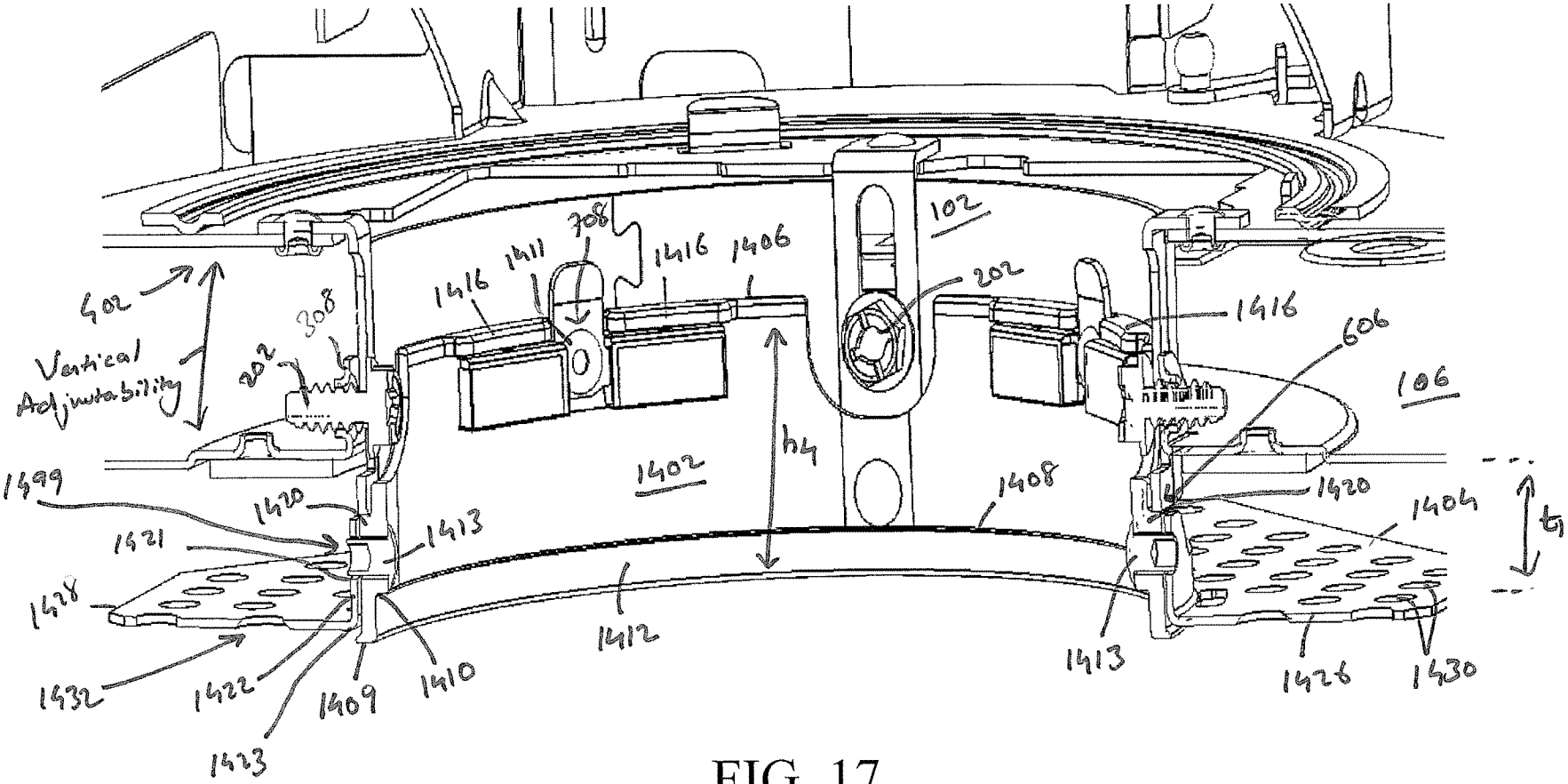
FIG. 17 illustrates an enlarged view of a cross-section of the mounting system of FIG. 16 along the C-C' axis, in accordance with example embodiments of the present disclosure.

Furthermore, the third body 1402 may include a plurality of clearance notches 1414 that are substantially U-shaped, and a plurality of coupling apertures 708. Each coupling aperture 708 may be disposed between adjacent clearance notches 1414 and is configured to receive a fastener 1411 therethrough to couple a magnet housing bracket 714 to the third body 1402 of the second lower collar 1400. The coupling apertures 708 of the second lower collar 1400 may be disposed adjacent the third top edge 1406 such that in the second lower collar 1400, the magnet housing bracket 714 and the magnets 724 housed therein are positioned adjacent the third top edge 1406 of the second lower collar 1400 instead of being positioned adjacent the bottom edge of the body as in the first lower collar 104 or the tall lower collar 1302. The third body 1402 of the second lower collar 1400 may further include a plurality of stop tabs 1416 that extend radially inward towards a central aperture 1418 defined by the third body 1402 from the third top edge 1406 of the third body 1402. The stop tabs 1416 may be disposed adjacent the coupling apertures 708 as illustrated in FIGS. 15 and 17.

Additionally, the third body 1402 of the second lower collar 1400 may include a plurality of attachment protrusions 1420 disposed below respective clearance notches 1414 and above the lip 1410, where each attachment protrusion 1420 includes an attachment hole. The attachment holes may be configured to receive fasteners 1413 therethrough to couple the lathing ring 1404 to the third body 1402 of the second lower collar 1400.

Figure 14:
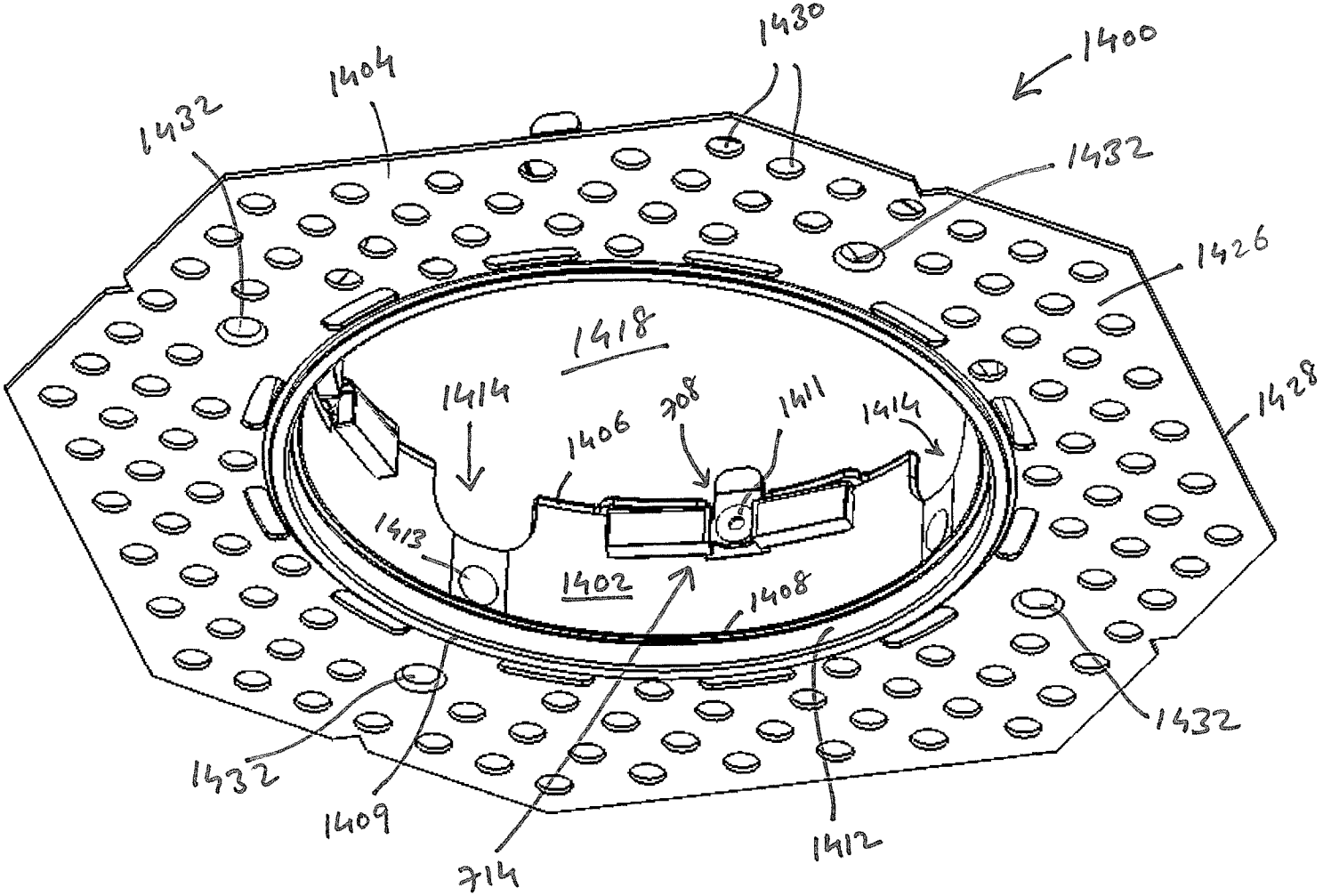
FIG. 14 illustrates a perspective view of a second lower collar of the mounting system of FIG. 1, in accordance with example embodiments of the present disclosure.

The lathing ring 1404 may include an annular collar 1422 that defines an opening 1424. The annular collar 1422 may extend from a top annular edge 1421 to a bottom annular edge 1423 and has an inner surface 1424*a* and an outer surface 1424*b*. The annular collar 1422 may include attachment openings 1499 formed therein. Further, the lathing ring 1404 may include an outer flange 1426 that extends radially outward from the bottom annular edge 1423 of the annular collar 1422. The outer flange 1426 may be substantially perpendicular to or may extend slightly upward forming an acute angle with the collar 1422. In some example embodiments, the outer flange 1426 may be slightly feathered to the outer edge 1428 allowing for an even transition to a ceiling surface (e.g., bottom surface 1006 of the ceiling 1002). In certain example embodiments, the outer edge 1428 of the outer flange 1426 may define an octagonal shape as illustrated in FIGS. 14-15. However, in other example embodiments, the outer edge 1428 of the outer flange 1426 may define any other appropriate shape, such as circle, rectangle, square, etc., without departing from a broader scope of the present disclosure.

Further, the outer flange 1426 of the lathing ring 1404 may include a plurality of perforated openings 1430 that are formed circumferentially around the outer flange 1426 and extend through the thickness of the outer flange 1426. The perforated openings 1430 facilitate plastering on the outer flange 1426 since these perforated openings 1430 provide an area for the plaster to adhere itself. Additionally, the outer flange 1426 may include one or more mounting holes 1432 disposed around and extending through the outer flange 1426. The one or more mounting holes 1432 may be configured to receive fasteners therethrough to secure the lathing ring 1404 to the ceiling 1002.

Figure 19:
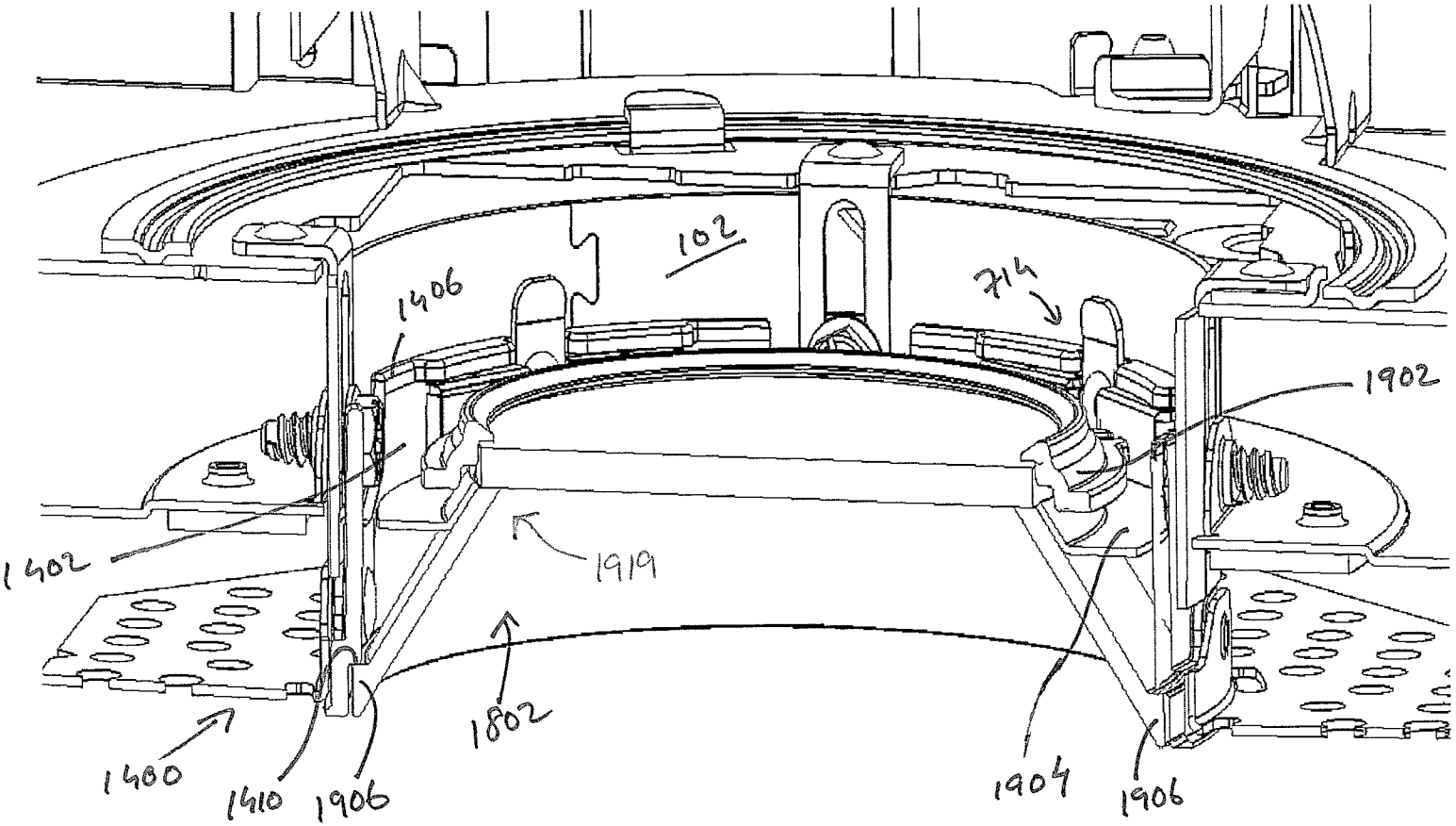
FIG. 19 illustrates an enlarged view of a cross-section of the mounting system of FIG. 16 with the rimless finishing section coupled thereto, in accordance with example embodiments of the present disclosure.
Figure 20:
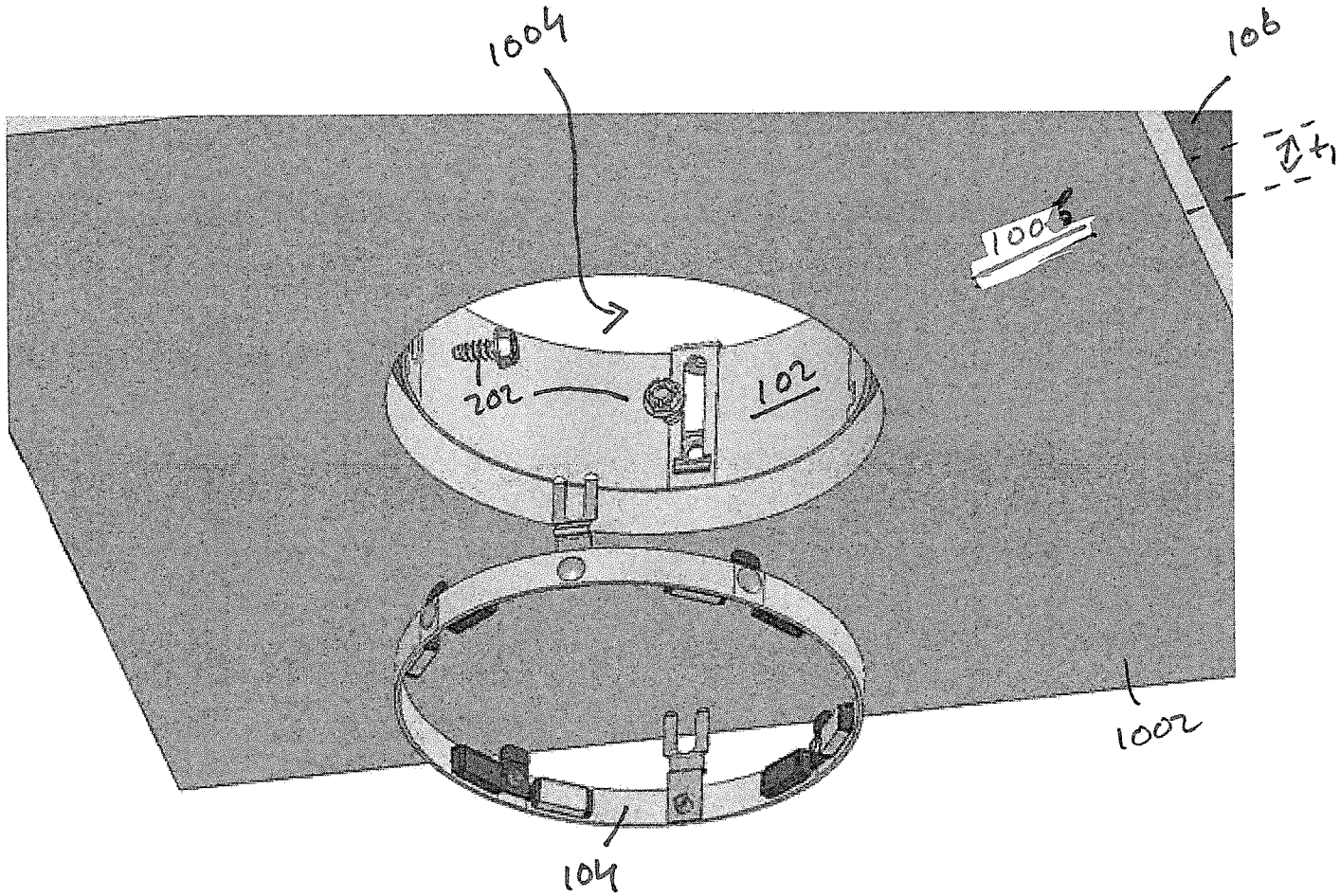
FIGS. 20-22 illustrate a method of converting the mounting system of FIG. 1 that is configured for installation of the rimmed finishing section in the recessed luminaire to the mounting system of FIG. 16 that is configured for installation of the rimless finishing section in the recessed luminaire, in accordance with example embodiments of the present disclosure.
Figure 21:
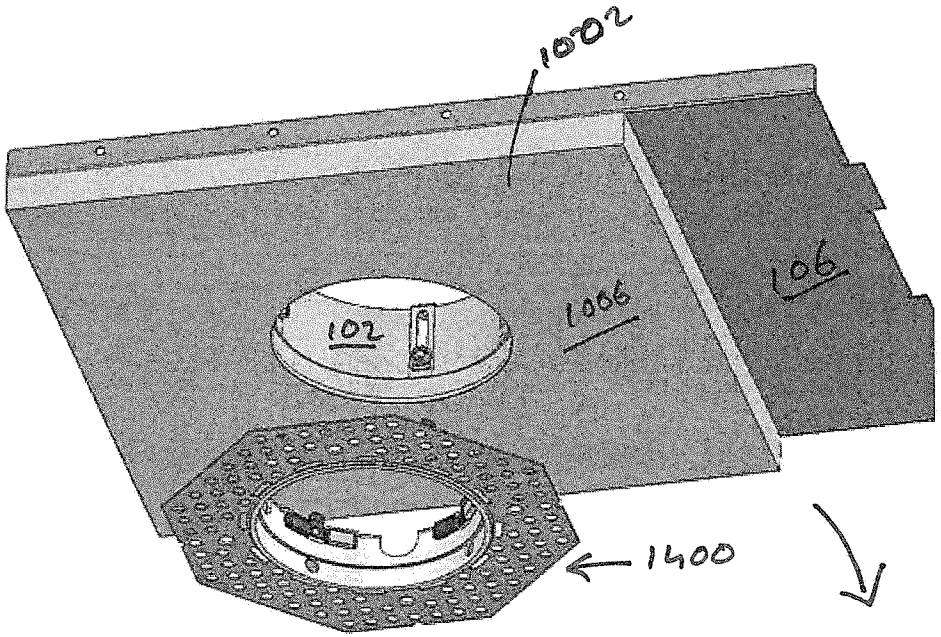
Figure 22:
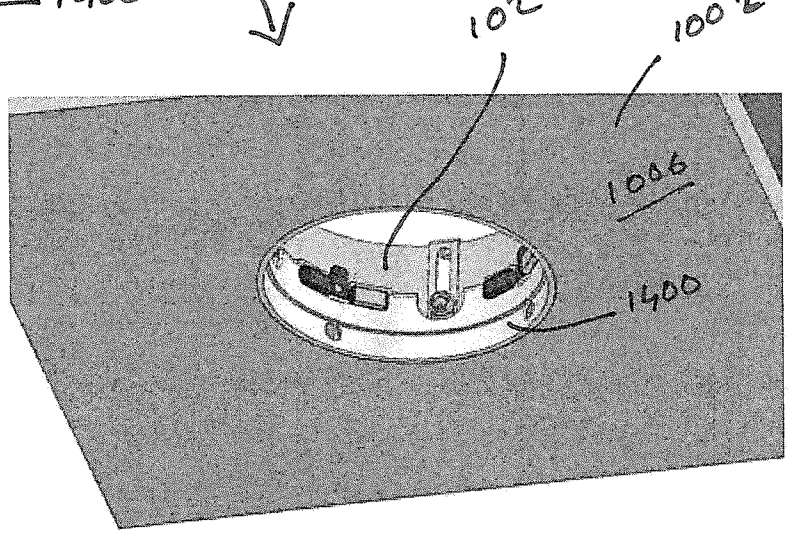

As illustrated in FIGS. 20-22, for a rimless installation of a recessed luminaire with the rimless finishing section 1802, the first lower collar 104 may be removed from the mounting system 100 by disengaging the first lower collar 104 from the upper collar 102. The mounting system 100 may be shipped from the factory for use with a rimmed finishing section. That is, the mounting system 100 that is shipped from the factory may include a first lower collar 104 that is attached to the upper collar 102. Responsive to disengaging the first lower collar 104 from the upper collar 102, the first lower collar 104 may be replaced with the second lower collar 1400. The second lower collar 1400 may be disposed below the ceiling 1002 and axially aligned with the light emitting opening 1004 in the ceiling 1002. Further, as illustrated in FIGS. 17 and 19, the second lower collar 1400 may be pushed up towards the ceiling 1002 till: (a) the outer flange 1426 of the lathing ring 1404 of the second lower collar 1400 engages the bottom surface 1006 of the ceiling 1002, (b) an outer surface of the third body 1402 engages or fits within the opening 699 defined by the upper collar 102, (c) the first bottom edge 606 of the upper collar 102 engages the top of the attachment protrusions 1420 of the third body 1402, and (d) the clearance notches 1414 are disposed about the fasteners 202 that couple the upper collar 102 to the plaster frame 106. Then, fasteners (not shown) may be passed through the mounting holes 1432 of the outer flange 1426 of the lathing ring 1404 and the thickness of the ceiling 1002 to attach and securely hold the second lower collar 1400 in place.

Figure 18:
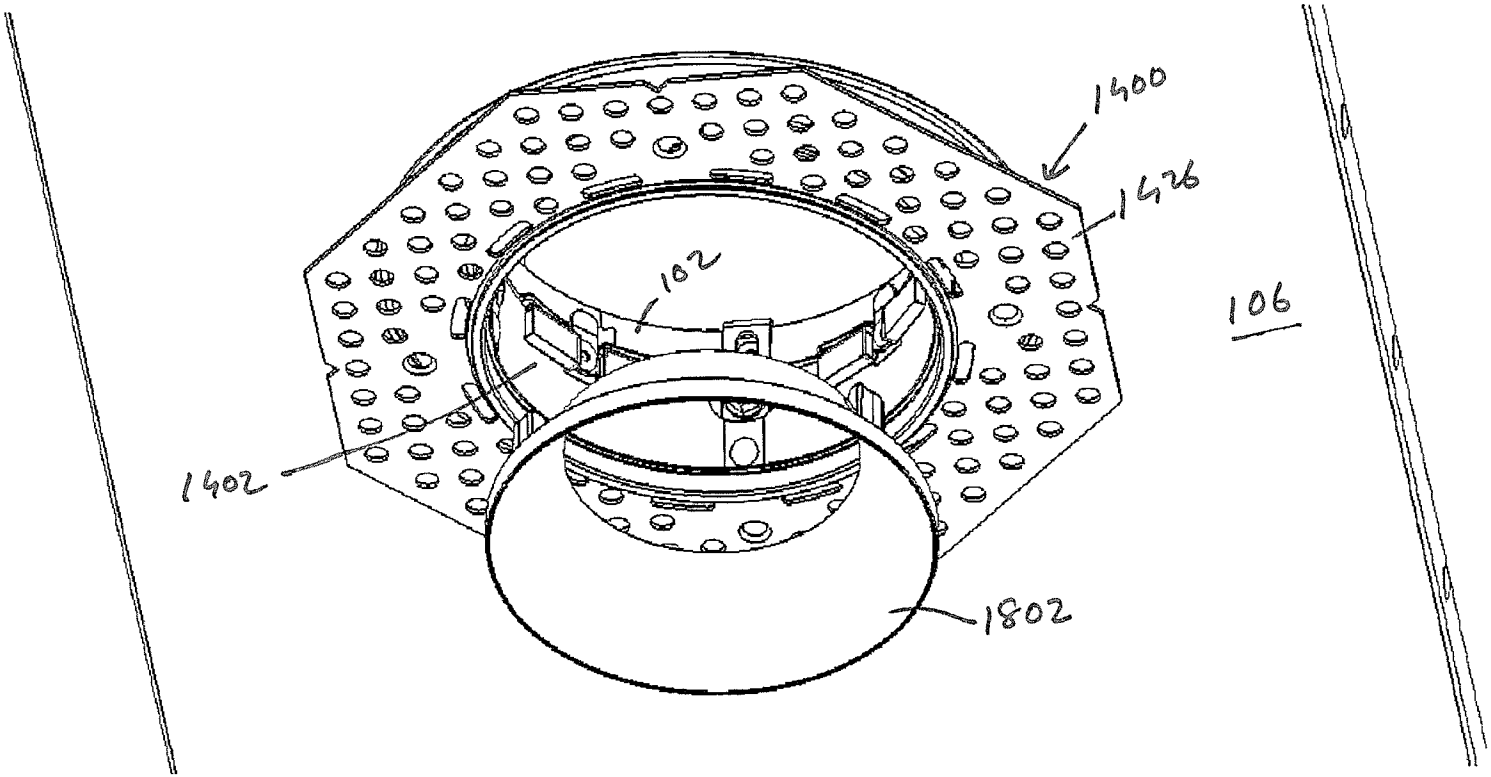
FIG. 18 illustrates an enlarged view of the mounting system of FIG. 16 that is coupled to the plaster frame and a rimless finishing section that is configured to be installed in a recessed luminaire via the mounting system of FIG. 16, in accordance with example embodiments of the present disclosure.

As described above, the second lower collar may be configured to mount a rimless finishing section 1802 to a recessed luminaire as illustrated in FIG. 18. In particular, as illustrated in FIG. 19, since the rimless finishing section 1802 does not have a rim for positioning the plurality of magnetic plates 1202 thereon, the rimless finishing section 1802 may include a magnetic plate 1904 that is attached to the rimless finishing section using a finishing section bracket 1902. The finishing section bracket 1902 may securely holds the magnetic plate 1904 adjacent to an upper edge 1919 of the rimless finishing section 1802 such that they can engage the magnets 724 disposed in the magnet housing brackets 714 positioned adjacent the third top edge 1406 of the third body 1402 of the second lower collar 1400.

Figure 23:
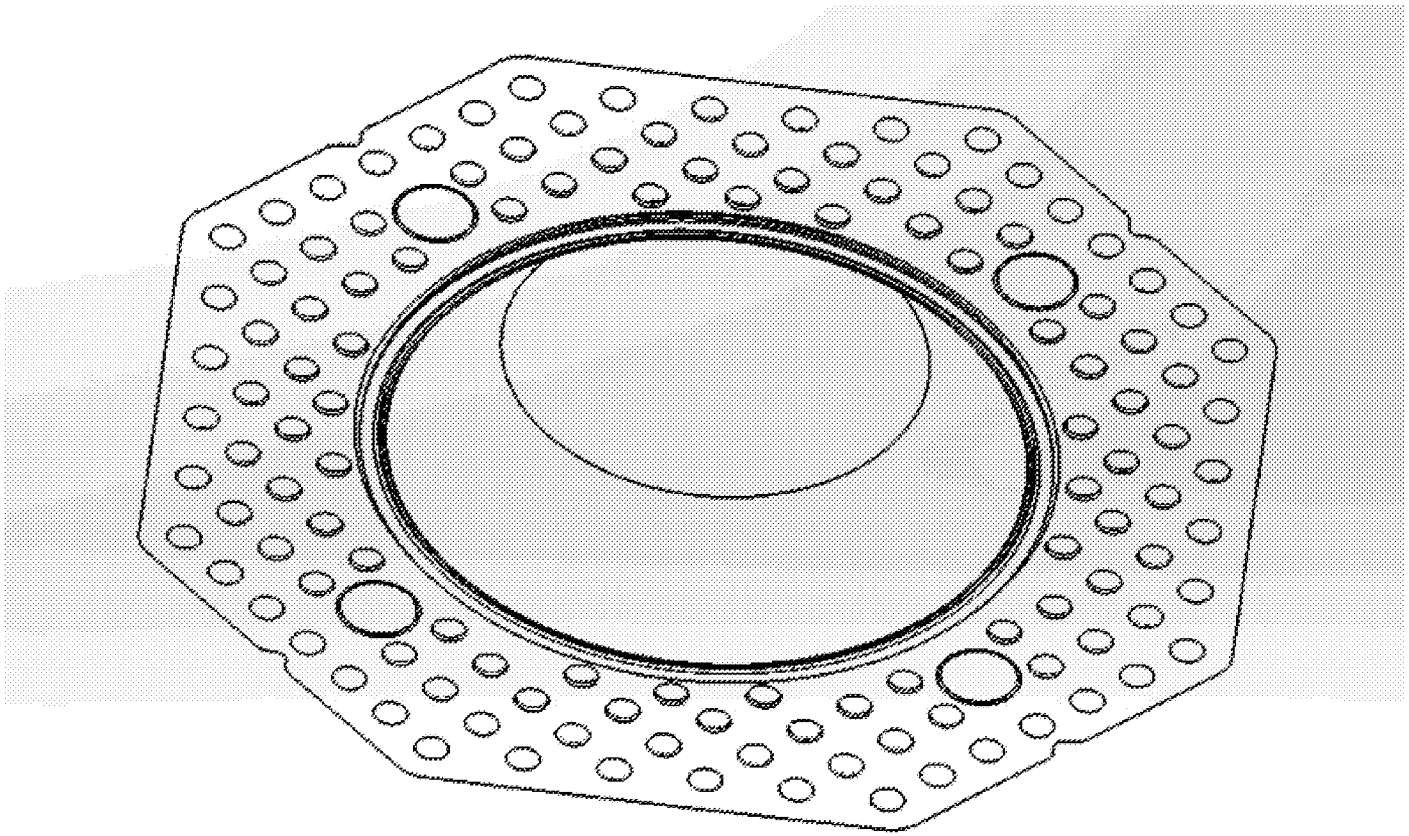
FIG. 23 illustrates a mounting system of the present disclosure with an attached luminaire in accordance with example embodiments of the present disclosure.

Once the first lower collar 104 is replaced with the second lower collar 1400, plaster may be applied over the outer flange 1426 of the lathing ring 1404 to create a smooth rimless appearance as illustrated in FIG. 22. Further, an end user may position the rimless finishing section 1802 below the ceiling 1002 such that the rimless finishing section 1802 is axially aligned with the light emitting opening 1004 of the ceiling 1002 and the magnetic plate 1904 is aligned with the magnets 724 housed within the magnet housing brackets 714 of the second lower collar 1400. Responsively, as illustrated in FIGS. 18-19, the magnets 724 housed within the magnet housing brackets 714 of the second lower collar 1400 may attract the complementary magnetic plate 1904 disposed adjacent the top edge 1919 of the rimless finishing section 1802, which in turn pulls the rimless finishing section 1802 up towards the ceiling 1002 till the light trap edge 1906 of the rimless finishing section 1802 engages the lip 1410 of the third body 1402 of the second lower collar 1400. A halo light effect resulting from leaked light around the perimeter of the rimless finishing section 1802 may be eliminated when the light trap edge 1906 of the rimless finishing section 1802 engages the lip 1410 of the second lower collar 1400. FIG. 23 illustrates an example mounting system of the present disclosure with an attached luminaire.

Even though the present disclosure describes the first body 602 of the upper collar 102, the second body 702 of the first lower collar 104, the tall lower collar 1302, and the third body 1402 of the second lower collar 1400 as being substantially ring shaped and defining round openings, one of skill in the art can understand and appreciate that in other example embodiments, the different upper and lower collars (102, 104, 1302, 1400) and the openings defined by each of the collars may have any other appropriate shape without departing from a broader scope of the present disclosure. For example, in some examples, the first body 602 of the upper collar 102, the second body 702 of the first lower collar 104, the tall lower collar 1302, and the third body 1402 of the second lower collar 1400 may be substantially square shaped, oval shaped, etc., and the openings defined by them may be square, oval, etc.

Although the present disclosure is described with reference to example embodiments, it should be appreciated by those skilled in the art that various modifications are well within the scope of the present disclosure. From the foregoing, it will be appreciated that an embodiment of the present disclosure overcomes the limitations of the prior art. Those skilled in the art will appreciate that the present disclosure is not limited to any specifically discussed application and that the embodiments described herein are illustrative and not restrictive. From the description of the example embodiments, equivalents of the elements shown therein will suggest themselves to those skilled in the art, and ways of constructing other embodiments of the present disclosure will suggest themselves to practitioners of the art. Therefore, the scope of the present disclosure is not limited herein.

What is claimed is:

1. A mounting system comprising:

an upper collar; and a lower collar that is configured to magnetically couple a rimless finishing section to a recessed luminaire, wherein the lower collar is removably coupled to the upper collar when the rimless finishing section is to be coupled to the recessed luminaire.

2. The mounting system of claim 1, wherein the upper collar comprises:

an upper collar body that extends from an upper collar top edge to an upper collar bottom edge.

3. The mounting system of claim 2, wherein the upper collar further comprises:

a first slot that is formed in the upper collar body; and a second slot that is formed in the upper collar body and disposed adjacent the first slot.

4. The mounting system of claim 3, wherein the second slot comprises a wide portion and a narrow portion, the wide portion and the narrow portion providing an inverted T-shape.

5. The mounting system of claim 4, wherein the upper collar further comprises:

a coupling tab that is substantially perpendicular to the upper collar body and extends radially outward from the upper collar top edge.

6. The mounting system of claim 1, wherein the lower collar comprises:

a lower collar body that extends from a lower collar top edge to a lower collar bottom edge.

7. The mounting system of claim 6, wherein the lower collar further comprises:

a lathing ring coupled to the lower collar body adjacent the lower collar bottom edge such that an outer flange of the lathing ring extends radially outward from the lower collar body.

8. The mounting system of claim 7, wherein the lower collar further comprises:

at least one magnet housing bracket that is configured to house one or more magnets therein, the at least one magnet housing bracket coupled to the lower collar body such that the one or more magnets housed therein are disposed adjacent the lower collar top edge.

9. The mounting system of claim 7, wherein the outer flange comprises a plurality of perforated openings and one or more mounting holes, and wherein the one or more mounting holes are configured to receive fasteners therethrough to mount the lower collar to a ceiling.

10. The mounting system of claim 6, wherein the lower collar body further comprises:

a lip that extends radially outward from an intermediate edge of the lower collar body, the intermediate edge disposed between the lower collar top edge and the lower collar bottom edge.

11. The mounting system of claim 10, further comprising a flange that extends down and substantially perpendicular to the lip from an outer edge of the lip to the lower collar bottom edge.

12. The mounting system of claim 10, further comprising an attachment protrusion disposed above the lip and comprising an attachment hole that is configured to receive a fastener therethrough to couple a lathing ring to the lower collar body.

13. A luminaire comprising:

a mounting system that is adjustably coupled to a plaster frame and configured to couple a rimless finishing section to the luminaire, the mounting system comprising:

an upper collar; and a lower collar that is configured to magnetically couple the rimless finishing section to the luminaire, wherein the lower collar is removably coupled to the upper collar when the rimless finishing section is to be coupled to the luminaire.

14. The luminaire of claim 13, wherein the upper collar comprises an upper collar body that extends from an upper collar top edge to an upper collar bottom edge.

15. The luminaire of claim 14, wherein the upper collar further comprises:

a first slot that is formed in the upper collar body; and a second slot that is formed in the upper collar body and disposed adjacent the first slot.

16. The luminaire of claim 15, wherein the second slot comprises a wide portion and a narrow portion, the wide portion and the narrow portion defining an inverted T-shape.

17. The luminaire of claim 16, wherein the upper collar further comprises:

a coupling tab that is substantially perpendicular to the upper collar body and that extends radially outward from the upper collar top edge, the coupling tab comprising a coupling hole that is configured to receive a fastener therethrough to couple the upper collar to a portion of the recessed luminaire.

18. The luminaire of claim 13, wherein the lower collar comprises:

a lower collar body that extends from a lower collar top edge to a lower collar bottom edge.

19. The luminaire of claim 13, wherein the lower collar further comprises:

a lathing ring coupled to the lower collar body adjacent the lower collar bottom edge such that an outer flange of the lathing ring extends radially outward from the lower collar body adjacent the lower collar bottom edge.

20. The luminaire of claim 13, wherein the lower collar further comprises:

at least one magnet housing bracket configured to house one or more magnets therein, the at least one magnet housing bracket being coupled to the lower collar body such that the one or more magnets housed therein are disposed adjacent the lower collar top edge.

* * * * *